US008932144B2

(12) United States Patent
Simizu

(10) Patent No.: US 8,932,144 B2
(45) Date of Patent: Jan. 13, 2015

(54) PUTTER

(75) Inventor: Kiyosi Simizu, Yokohama (JP)

(73) Assignee: Taiseikogyo Co., Ltd., Yokohama (JP)

( * ) Notice: Subject to any disclaimer, the term of this patent is extended or adjusted under 35 U.S.C. 154(b) by 295 days.

(21) Appl. No.: 13/370,010

(22) Filed: Feb. 9, 2012

(65) Prior Publication Data

US 2013/0040750 A1 Feb. 14, 2013

(30) Foreign Application Priority Data

Aug. 10, 2009 (JP) ..... 2009-185758

(51) Int. Cl.
*A63B 69/36* (2006.01)
*A63B 53/04* (2006.01)
*A63B 53/06* (2006.01)

(52) U.S. Cl.
CPC ..... *A63B 53/0487* (2013.01); *A63B 53/065* (2013.01); *A63B 2053/0441* (2013.01)
USPC ..... 473/238; 473/240; 473/242; 473/244; 473/251; 473/340; 473/349; 473/254

(58) Field of Classification Search
CPC ..... A63B 53/0487; A63B 2053/0441; A63B 53/065
USPC ..... 473/231, 238, 240, 241, 244, 251–256, 473/340, 341, 331, 349
See application file for complete search history.

(56) References Cited

U.S. PATENT DOCUMENTS 697,542 A * 4/1902 Robertson ..... 473/251
2,932,515 A * 4/1960 May ..... 473/248
4,032,156 A * 6/1977 Clarke ..... 473/253
4,136,877 A * 1/1979 Antonious ..... 473/254
4,343,472 A * 8/1982 Hamilton ..... 473/240
4,458,900 A * 7/1984 Antonious ..... 473/254
4,629,193 A * 12/1986 Pierman ..... 473/254
4,647,045 A * 3/1987 Bilyeu ..... 473/238
4,986,544 A * 1/1991 Benson ..... 473/254
5,447,313 A * 9/1995 Finley ..... 473/244
5,538,249 A * 7/1996 Benson ..... 473/254
5,676,603 A * 10/1997 Miller ..... 473/220

(Continued)

FOREIGN PATENT DOCUMENTS

JP 53-118764 U 9/1978
JP 54-94466 U 7/1979

(Continued)

OTHER PUBLICATIONS

International Search Report for parent application PCT/JP2010/063504, having a mailing date of Nov. 9, 2010.

*Primary Examiner* — Sebastiano Passaniti

(74) *Attorney, Agent, or Firm* — Andrus Intellectual Property Law, LLP

(57) ABSTRACT

When hitting a ball to a target with a putter, the ball often travels to a point which is deviated to the right from the target. When a golfer looks at the target just after taking his address, he turns his head to a target about a rotation axis which extends through the back of his head. When this rotation axis is not horizontal and an angle defined by the rotation axis and his sighting line to a putter head is not 90°, he has an optical illusion which tricks him into believing that he has to correct his address position. The putter of the present invention is provided with a thin-plate pendulum thereby allowing him to turn his head about the rotation axis while keeping the angle defined by the rotation axis and his sighting line at 90°.

15 Claims, 20 Drawing Sheets

(56) References Cited

U.S. PATENT DOCUMENTS

| | | | | |
|---|---|---|---|---|
| 6,062,986 | A * | 5/2000 | Kaise | 473/242 |
| 6,558,268 | B2 * | 5/2003 | Tindale | 473/244 |
| 7,108,613 | B1 * | 9/2006 | Gordon et al. | 473/341 |
| 7,226,362 | B1 * | 6/2007 | Schell et al. | 473/238 |
| 7,341,526 | B2 * | 3/2008 | McCarthy | 473/251 |
| 7,393,285 | B2 * | 7/2008 | Stellander | 473/251 |
| 7,758,439 | B2 * | 7/2010 | Roenick | 473/238 |
| 7,766,762 | B2 * | 8/2010 | Stellander | 473/251 |
| 8,128,505 | B2 * | 3/2012 | Tryner et al. | 473/242 |
| 2012/0178549 | A1 * | 7/2012 | Yoon | 473/334 |

FOREIGN PATENT DOCUMENTS

| | | | |
|---|---|---|---|
| JP | 2006-326216 | A | 12/2006 |
| JP | 2007-160033 | A | 6/2007 |

* cited by examiner

PUTTER

CROSS-REFERENCE TO RELATED APPLICATIONS

This application is a continuation-in-part of International Application No. PCT/JP2010/063504, filed on Aug. 9, 2010, which International application was published on Feb. 17, 2011, as International Publication No. WO2011/019024 A1 in the Japanese language and which application is incorporated herein by reference. The International application claims priority of Japanese Patent Application No. 2009-185758 filed on Aug. 10, 2009, to which application is incorporated herein by reference.

BACKGROUND OF THE INVENTION

The present invention relates to a putter which serves to prevent a golfer from being affected by an optical illusion which tends to occur when the golfer putts a ball to a target.

As means for assisting a golfer hit a straight putt, provided is a putter of which head is provided with a line slot extending through a center of the head and perpendicular to a putting face of the putter, and provided is a putter including a head with two white dot graphics in side by side relation in a hitting direction on its surface. The white dot graphics have the same contours as balls, respectively. These putters allow a golfer to align easily an orientation of a head of a putter to a target. However, a golfer usually looks at the target again for reconfirmation just before putting a ball to the target. At that time, the golfer's eyes often arrive at a point which is deviated to the left from an actual target. The golfer is tricked into believing that the reason why his eyes arrive at the point deviated to the left from the target is that he takes his address position incorrectly to the left, corrects and adjusts his address position to the right, and putts a ball. Then, the ball putted is deviated to the right from the target.

In order to solve this problem, Patent Document 1 discloses a putter which has an L-shaped pendulum to its slit. However, according to this putter, at address, a golfer must place a putter head horizontally, and the golfer cannot hold the putter at a proper angle so as to fit the lie angle of the putter which varies among golfers.

[Patent Document 1] JP-A, 2007-160033

SUMMARY OF THE INVENTION

When a right-handed golfer takes his address position for putting, in many cases, the right-handed golfer has a mistaken perception that the actual target is deviated to the right from a point targeted in his address position. This caused a problem that the golfer could strike the ball for proper distance with ball rolling smoothly, but as a result, the ball arrived at the point deviated to the right from the target, while the golfer who putted the ball did not understand the reason why an intended target line is deviated from the target.

The object of the present invention is to provide a putter which allows a golfer to putt a ball accurately to the target by eliminating optical illusion which tends to occur with respect to a target direction of putting.

According to the basic idea of the above prior art where the L-shaped pendulum with a thin horizontal hand on its top is provided in a center of the long slit, when a golfer places a putter head horizontally, viewing the putter head from straight above, the horizontal hand of the pendulum can be seen in the center of the upper slit. And since inner walls of the upper and the lower slits are located on an identical vertical surface (a virtual surface), for example, these inner walls are not seen by the golfer. Therefore, viewing the putter head from straight above, when the inner walls of the upper and the lower slits is not seen by the golfer, namely, the golfer's sighting line (using both eyes) is in line with the vertical surface defined by the slits.

The golfer rotates his head about an rotating axis which is a line extending through the back of his head or extending through from the back of his head to his backbone in order to direct the sighting line to the target. Here, when the rotation axis is horizontal and the rotation axis is perpendicular to his sighting line, he can look at the target without creating such illusion that the target is deviated to the right.

Here, it is necessary for the golfer to hold the putter head horizontally. However, since body height, hand length, and shoulder width, etc. vary from person to person, one has his own manner for taking his address position in putting which has been already acquired and accustomed to. In case the putter is used in a golfer's own manner, he cannot take his address position in putting and putt a ball. When a golfer who usually sets his hands ahead of a ball with the putter head tilted toward himself holds a putter naturally, the golfer cannot place the putter horizontally, for example, with a toe of the putter head uprising. That means, unless the golfer changes fundamentally his address position with which he has been familiar to date, he cannot hold the putter horizontally, therefore cannot take advantage of the functions of the above putter. In other words, the golfer cannot use the putter according to the shape of his body. Instead, in order to place the putter head horizontally, it is required for the golfer to change an angle or position of the joint of his body, etc. to suit the putter. Under the circumstances, demanded is a putter which can prevent the golfer from having optical illusion and which is easy to use for a golfer who does not take his address position with a putter head horizontally.

Now, the inventor has developed a new putter, thereby solved the problem. The putter comprises a putter head, a thin-plate pendulum body disposed perpendicular to or generally perpendicular to a surface of a sole and a hitting surface of the putter head and a rotation axis disposed on a back side or an opposite side of the hitting surface, for example, at a position corresponding to a center portion of the hitting surface. The thin-plate pendulum body serves as a pendulum being able to pivot in directions perpendicular to the rotation axis. Or the thin-plate pendulum body is disposed perpendicular to a horizontal plane (a virtual plane) and the putter head.

When a golfer hits a ball to a target without any previous technical knowledge, the ball will go to the right of the target. This applies not only to putters but also to other golf clubs such as a driver. When a golfer tries to look at the target in natural posture just after he looks down at a ball in front of him, namely just before putting the ball, his eyes track to the left of the target. The target is deviated to the right from a point at which his eyes arrive. To follow a target line with his eyes, he rotates his head about a rotation axis which is a straight line extending through the back of his head or extending through from the back of his head to his backbone. Because the rotation axis is angled or oblique relative to a horizontal plane, an error is caused in a direction in which eyes tracks to the target.

This error will be explained with reference to FIG. 10 showing address of a putt.

When a golfer hit a ball toward a target, he first looks at and confirms the target point O. Then, he shifts his eyes to the ball in front of him, and he takes his address, checking a position of the ball, an orientation of his body, etc. After address, for reconfirmation just before putting a ball, the golfer again turns his head so that his eyes track from the ball in front of him to the target over the green. As shown in FIG. 10, when his eyes track an intended target line, his eyes arrive at a point O1 which is deviated to the left from the target point O. However, the actual target point is O. Then, an optical illusion tricks him into believing his posture is directed to the point O1 instead of the actual target point O. This optical illusion is caused by the fact that he turns his head while the rotation axis is angled by an angle a relative to a horizontal plane and an elevation/depression angle θ defined by the rotation axis and his sighting line is not a right angle. Since the golfer turns his head about the rotation axis $A_0$-$C_0$ at a rotation angle γ, his eyes track points $M_1$, $M_2$ . . . $M_6$ . . . $M_9$ and $M_{10}$ on a curved line to the point $O_1$ on the green. However, the actual target point is not the point $O_1$ but the point O which is at the right of the point $O_1$. At that time, the golfer does not think that his eyes follow a curved line toward an incorrect direction, but believes that his eyes track a correct target line. So, he misunderstands that if he putts a ball without correcting his address, the ball will roll toward the point $O_1$ which is at the left of the target point O.

Although he takes his address correctly in fact, he mistakenly believes that his address is deviated, therefore should be corrected to the correct direction. Then, he tries to hit the ball to the target point O by slightly rotating his shoulder in the right direction so as to modify the intended target (a goal of the ball) slightly to the right. He is confident that the direction of a putt is changed or corrected from the direction to the point $O_1$ to the direction to the point O. That is, he changes his correct address slightly to the right. This results that the ball putting line which was initially oriented to the correct target point O is oriented to the point $O_2$ because the golfer slightly tilts his shoulders to the right (refer to FIG. 12 (B)).

The above explanation is given about a putter. However, a deviation caused by such optical illusion in golf with a golf club having a large head such as a driver is large. An optical illusion tricks a golfer into believing a straight line extending from a ball parallel to his shoulders arrives at the point $O_1$, therefore, the correct target point O, for example, among trees as an indicator is viewed by him as being deviated to the right. Unfortunately, he does not understand why such deviation is caused, he adjusts his posture in the closed stance by turning his shoulders to the right to conform the point $O_1$ which is regarded as a target of a ball by optical illusion with the actual target point O. As a result, the direction of a putt is oriented to the point $O_2$, however, the golfer is confident that he takes his address correctly.

When a target is 100 yards away or farer, a golfer can recognize whether his address position is directed to the target by viewing the target from the back of the ball. On the other hand, when a target is a few yards away in putting, a golfer cannot recognize whether a ball hitting direction is deviated from the actual target, and hits a ball incorrectly to the right without knowing the reason.

Some world's top professional golfers putt a ball taking a posture with his rotation axis inclined. They seem to have acquired a sense of correcting such deviation through great amount of practice from their childhood. On the contrary, it is difficult for amateur golfers with a limited amount of practice to acquire this sense of correcting the deviation.

The optical illusion will be further explained in the following with reference to FIG. 11. FIG. 11 shows a direction of the golfer's sighting line when a golfer's eyes track a target line, in the case that a rotation axis about which the golfer turns his head is not inclined to a horizontal plane, namely, an inclination angle a=0. At the same time, an elevation/depression angle θ defined by the rotation axis and his sighting line is a right angle. When a golfer's eyes track a target line on the ground, no optical illusion is created since the rotation axis is horizontal (refer to FIG. 12(A)). While the golfer turns his head about the rotation axis, his eyes track the points $M_1$, $M_2$ . . . $M_6$ . . . $M_9$ and $M_{10}$ which define a straight line, and arrive at the target point O. No deviation due to optical illusion occurs.

FIG. 12 shows a rotational motion of the golfer's head about the rotation axis extending through the back of his head while the golfer's eyes track a target line. The upper figure (A) shows a rotational motion about the rotation axis which is horizontal. The lower figure (B) shows a rotational motion about the rotation axis which is inclined relative to the horizontal plane, where optical illusion occurs.

When the rotation axis is inclined relative to the horizontal plane or when the elevation/depression angle θ defined by the rotation axis and his sighting line is not a right angle, the golfer's eyes track a curved target line instead of a straight target line on the green, thereby optical illusion is caused. The curved target line is expressed by an equation (1) as below, therefore the equation is named the Illusion Equation.

[Equation 1]

a: Inclination angle of a rotation axis $A_0C_0$: Rotation axis

γ: Rotating angle $H_0$: Height of the rotation axis from surface of the green

θ: elevation/depression angle defined by the rotation axis and golfer's sighting line $$\frac{y^2}{\left(\frac{H_0\tan\theta\cdot\sin(\theta+\alpha)}{\sqrt{\frac{\cos^2\theta-\cos^2\alpha}{\cos^2\theta}}}\right)^2}+\frac{\left(x-\frac{H_0\tan\theta\cdot\sin(\theta+\alpha)}{\frac{\cos^2\theta-\cos^2\alpha}{\cos^2\theta}}\right)^2}{\left(\frac{H_0\tan\theta\cdot\sin(\theta+\alpha)}{\frac{\cos^2\theta-\cos^2\alpha}{\cos^2\theta}}\right)^2}=1$$

The condition that no optical illusion is caused is; a: Inclination angle of a rotation axis=0, θ: elevation/depression angle defined by the rotation axis and golfer's sighting line=90°. This is a singularity of Illusion Equation (1), and a solution for Equation X=±1. This means a straight line passing through points $B_0$, O. That is, only under the condition, a golfer's eyes track a straight target line and do not track a curved line on the green, therefore, optical illusion does not occur.

FIG. 9 shows a movement of the golfer's eyes which track a line to the target point O, parallel to the golfer's shoulders. The rotation axis extending through the back of the head $A_0C_0$ is kept horizontal, and the elevation/depression angle defined by the horizontal rotation axis and the golfer's sighting line is 90°. A putter head 1 has a planar pendulum or a thin-plate or sheet pendulum 6 which comprises a planar pendulum body or a thin-plate or sheet pendulum body 6*a* provided with a rotating shaft 8, as shown in FIG. 1. The sheet pendulum body 6*a* is disposed perpendicular to or generally perpendicular to a surface 20 of a sole 7, for example, when the putter head 1 is placed horizontally, and is disposed perpendicular to or generally perpendicular to a hitting surface (refer to reference numerals 17 and 40). An iron weight 9 is provided on a lower portion of the thin-plate pendulum body 6*a* or the thin-plate pendulum 6, thereby the pendulum 6 is kept always vertical or perpendicular to the horizontal plane, and defines a vertical plane 3. The golfer conforms his sighting line with the vertical plane 3. For example, the golfer moves his sighting line in a parallel fashion or horizontally, in order that a plane $E_1$, $E_2$, $P_1$, $P_2$ defined by his sighting line and the pendulum 6 is a vertical plane. Then, when the golfer turns his head with the rotation axis $A_0C_0$ of the back of his head being horizontal, a plane including $E_1$, $E_2$, $E_3$, $E_4$, $P_1$, $P_2$, B, O is defined and this plane is identical to a vertical plane defined by the pendulum 6. This fulfills the condition that no optical illusion is created as described with reference to FIG. 11, that is, a rotation axis extending through the back of his head is horizontal, and the elevation/depression angle defined by the rotation axis and golfer's sighting line is 90°. And, an error resulting from hitting with a hitting surface open or closed is not caused so often, and such an error can be adjusted. This error is so small as to slightly affect overspin of a ball.

FIG. 13 shows a putting posture at address viewed from a lateral side. In the condition where the rotation axis $A_0C_0$ extending through the back of his head is horizontal, but the elevation/depression angle θ defined by the rotation axis $A_0C_0$ and golfer's sighting line is not 90°, when the golfer looks at the thin-plate pendulum 6 through a first slit 4 from above, he sees a side surface 6*c* of the pendulum 6 because the pendulum 6 is always kept vertical. This is shown also in FIG. 15. At that time, the elevation/depression angle θ defined by the rotation axis $A_0C_0$ and golfer's sighting line is an obtuse angle larger than 90°, the golfer slightly moves his sighting line $A_0$ horizontally forward in order that the angle θ is 90°. When he sees the other side surface 6*c* of the pendulum 6, namely a side surface opposite to the side surface shown in FIG. 15, his sighting line is moved too forward, therefore, the elevation/depression angle θ is an acute angle smaller than 90°. In this case, the golfer slightly moves back his sighting line $A_0$ to adjust the elevation/depression angle θ to 90°. In this manner, his sighting line conforms to the vertical plane 3 by slightly adjusting his head and his sighting line. At that time, the golfer does not see the side wall or side surface of the sheet pendulum 6 and he can see only an upper surface 7 of the sheet pendulum 6, which means that he takes his address correctly. In other words, as long as the golfer takes his address with the rotation axis $A_0C_0$ horizontal, the elevation/depression angle θ defined by the rotation axis $A_0C_0$ and golfer's sighting line can be adjusted to 90° by looking at the sheet pendulum 6 which is always vertical.

In this manner, the sheet pendulum 6 is provided in and with respect to the slit of the putter head 1 so as to define a vertical surface, a ball and the golfer's sighting line conform to the vertical surface, then, the golfer's sighting line can be directed to the target point at the time of confirmation of the target point. Here, an error in putting is not regarded two-dimensionally as deviation to the right or the left, but regarded as deviation caused by an optical illusion based on sterical or three-dimensional factors. Thereby realized is a putter which allows a golfer to putting a ball accurately without causing an optical illusion in direction of putt.

And, the putter head 1 may be equipped with the sheet pendulum 6 so as to conform to the vertical plane 3 which extends through a center of the putter head 1 when the putter head 1 is horizontal However, here, it is not necessary to hold the putter with the putter head 1 horizontal. As already stated, a lie angle of the putter defined by the putter head 1 at address and the horizontal plane varies among golfers. As shown in FIG. 14, the golfer can confirm whether his sighting line is vertical or not by viewing from the above the sheet pendulum 6 which always conforms to the vertical plane 3. The golfer can he protected from having an optical illusion in taking his address to the target as usual without changing his own lie angle. For golfers who have techniques to place a putter always at his lie angle with high accuracy, the sheet or thin-plate pendulum 6 may be fixed. FIGS. 3 and 16 show that the sheet pendulum 6 is securely fixed for the golfer who takes his address with a forward hand press. FIG. 3 is a side view of the putter head 1 showing that the relationship between the sheet pendulum 6 and his sighting line A.sub.0 when he takes his address with a forward hand press to incline the putter head 1 at an angle d.

In FIG. 1, when the golfer places the putter head 1 horizontally at address, a center line of the first slit 4 conforms to an upper surface 7 of the sheet pendulum 6, and serves as an indicator for indicating a putting direction. When the golfer places the putter head 1 at an angle or a lie angle at address, a line on the upper surface 7 of the sheet pendulum 6 serves as an indicator toward a center of a ball. A cover 30 is provided against an external force which is applied to the sheet pendulum 6. For example, the cover 30 comprises an upper cover plate 30*a* which is located above the sheet pendulum 6 or at a position of an upper end of the sheet pendulum 6 and a lower cover plate 30*b* which is located below the sheet pendulum 6. The first slit 4 is formed in the upper cover plate 30*a*, while the second slit 5 is formed in the lower cover plate 30*b*. The lower cover plate 30*b* may be provided with reflectors or lighting reflectors 13 on an upper surface thereof at positions of both side edges of the second slit 5.

The upper cover plate 30*a* above the sheet pendulum 6 may be made of a reinforced glass or a light-transmissive resin plate so as to facilitate illuminating the side surfaces of the sheet pendulum 6 with lights.

A hitting surface of the putter head 1 may be made of a material which is effective in reduction of a friction resistance against a ball, thereby a spin of the ball in a direction lateral to a direction of movement can be reduced.

The putter head 1 may be formed with lateral slits on its hitting surface to add forward spin to a ball, thereby allowing a golfer to hit the ball so as to produce a better roll to the ball.

By constructing the sheet pendulum 6 with the sheet pendulum body 6*a* and the rotating shaft 8, the sheet pendulum 6 is allowed to rotate freely.

When the golfer places the putter head 1 with the second slit 5 horizontally at address, he is allowed to confirm whether he looks down at the putter head 1 or the sheet pendulum 6 vertically by checking whether the first and the second slits 4, 5 are vertically aligned, whether a side surface 6*c* of the sheet pendulum 6 can be seen. The second slit 5 produces the effect that a lightning condition of the sheet pendulum 6 is good.

Providing the lighting reflector or the light-collecting reflector 13 produces the effect that a lightning condition of the sheet pendulum 6 is good.

Here, the putter head 1 having the first and the second slits 4, 5 and the lighting or the light-collecting reflector 13 is explained.

When a golfer places the putter head 1 horizontally at address, the golfer can confirm whether he looks down at the putter head 1 or the sheet pendulum 6 vertically by two ways, by checking whether the first and the second slits 4, 5 are aligned (one on top of another), and by checking whether a side surface 6*c* of the sheet pendulum 6 can be seen. A triangular plane is defined by his sighting line to the sheet pendulum 6 and the target point. When the triangular plane conforms to the vertical plane 3, his eyes are at a position of $A_0$ as shown in FIG. 13, only the upper surface 7 of the sheet pendulum 6 is seen but both side surfaces thereof are not seen. And, since the first slit 4 and the second slit 5 are vertically aligned, the both side edges of the second slit 5 are not seen, but the green is seen below the slit 5. This putter head 1 provides a benefit of allowing the golfer to check his address in two ways. However, in case of rain or in early evening, sometimes it is hard for the golfer to see the edge of the second slit 5 even when the first slit 4 and the second slit 5 are not aligned. In order to solve the problem, the lighting reflector 13 is provided on each of the side edges or the side edge portions of the second slit 5, so that when the first and the second slit 4, 5 are not aligned and when the golfer looks at the slits 4, 5 from the above, the light reflector 13 can be seen like a light reflecting strip. When the golfer does not take his address correctly, the light reflector 13 and the side surface of the sheet pendulum 6 is seen as shown in FIGS. 13 and 15. When the light reflecting strip cannot be seen by adjusting slightly the golfer's sighting line horizontally, the first slit 4 and the second slit 5 are aligned, namely appear to be one slit. And, the triangular plane defined by his sighting line to the sheet pendulum 6 and the target point conforms to the vertical plane 3. In case that visibility is not so good, the golfer confirm whether his address is correct, that is, whether the triangular plane conforms to the vertical plane 3 in two ways.

FIG. 3 and FIG. 16 show the case that the sheet pendulum 6 is fixed and the golfer has a forward hand press at address. In FIG. 3, a lie angle is indicated by the character d. When the golfer places the putter head 1 at an angle or a lie angle d at address with a forward hand press, needless to say, the sheet pendulum 6 which is always vertical is inclined at an angle d with respect to the surface passing through the first and the second slits 4, 5 of the putter head 1. Here, when the golfer looks at the sheet pendulum 6 from straight above the putter head 1, regardless of both inner side edges or both side edges of the slits 4,5, he can see the upper surface 7 but not both side surfaces of the sheet pendulum 6 as stated previously. At that time, the triangular plane defined by his sighting line and the target conforms to a vertical surface of the sheet pendulum 6. Thereby the golfer is allowed to look at the target with an angle defined by the rotation axis extending through the back of his head $A_0C_0$ and his sighting line, at 90°. Hence, the golfer's eyes do not track a curved line by an optical illusion even when the golfer takes his address with a forward hand press.

Needless to say, in this case, a longitudinal center line of a top surface 7 of the sheet pendulum 6 does not conform to the center line of the slit 4. When the golfer takes his address with a forward hand press, regardless of an inclination angle of the putter head 1, the sheet pendulum 6 is kept vertical, and the upper surface 7 of the sheet pendulum 6 is deviated from the center of the first slit 4, close to an inner wall remote from the first slit 4 corresponding to inclination. That is, for a player who can always place the putter head 1 at a lie angle of d at address, the sheet pendulum 6 may be obliquely fixed at an angle of d.

By the way, some golfers do not require an aid of a tool with the belief that golf is a sport which is played using one's instinct. Or in some games, use of the golf club including a movable portion is limited according to the rules of the game. For such golfers, or for such games, the sheet pendulum 6 is securely fixed in the putter head 1 of the golf club or the putter. For example, the golf club or the putter having the sheet pendulum 6 which is fixable may be used as follows. The sheet pendulum 6 is securely fixed in the putter head 1 with a permanent magnet 10, so as to conform to a vertical surface of the putter head 1, namely a plane 3 extending through a sweet spot perpendicular to a sole surface of the putter head 1. FIG. 1 shows that the sheet pendulum 6 is provided with the iron weight 9 on the lower portion of the sheet pendulum 6 or on the lower portion with respect to the rotating shaft 8 of the sheet pendulum 6, the iron weight 9 is attracted to the permanent magnet 10 by its magnetic force, thereby the sheet pendulum 6 is fixed so as to conform to the plane 3 extending through the sweet spot perpendicular to the sole surface. In this manner, in order for the golfer to hit a ball for the target with the sheet pendulum 6 fixed without having an optical illusion, the golfer has to place the putter head 1 horizontally at address with the rotation axis $A_0C_0$ extending through the back of his head horizontal. On the contrary, FIG. 8 shows that the magnetic force of the magnet 10 is obstructed so that the sheet pendulum 6 rotates freely about the rotating shaft 8 and functions for its intended purpose.

FIGS. 13 and 16 show an address with a forward hand press viewed from a lateral side.

Here, the sheet pendulum 6 may be fixed in the following manner. For the golfer who takes his address with a forward hand press, the sheet pendulum 6 is fixed to the permanent magnet 10 so that the sheet pendulum 6 is vertical with respect to the horizontal plane when the golfer places the putter head 1 at a lie angle which fits his sensibilities. When he places the putter head 1 at a constant lie angle and he looks at the sheet pendulum 6 from above, the both side walls or surfaces 6*c* of the sheet pendulum 6 cannot be seen. This indicates that he takes his address correctly. As in the configuration for rotating the sheet pendulum 6 freely (refer to FIG. 13), when his sighting line is close to (b) (not correct address position), it is necessary to slightly adjust the elevation/depression angle θ defined by the rotation axis $A_0C_0$ and golfer's sighting line to 90°, and correct his sighting line to a position (a).

At that time, needless to say, since the golfer looks at the putter head 1 front above, his sighting line or the triangular plane defined by his sighting line and the target is perpendicular to the axis A.sub.0C.sub.0 extending through the back of his head. FIG. 2 is a top plan view of the putter head 1 showing a position of the permanent magnet 10 in the putter head 1 before the golfer fixes the sheet pendulum 6 at most optimum intended angle in case of a forward hand press. FIG. 3 is a sectional view of the putter head 1 viewed from back side, showing that the sheet pendulum 6 is fixed by the permanent magnet 10, and the golfer places the putter head 1 at an lie angle d at address in case of a forward hand press. FIG. 8, FIG. 13 and FIG. 14 show that the iron weight 9 is released from the permanent magnet 10, and that the golfer places the putter head 1 horizontal at address, or angled at address with a forward hand press. These figures also show the relationship between the position of the permanent magnet 10 and the iron weight 9 and the lie angle.

When the putter head 1 is used in a normal way so that the sheet pendulum 6 functions for its intended purpose, the magnetic attracting force prevents the sheet pendulum 6 from rotating freely. In order to avoid this problem, as shown in FIG. 8, a nonmagnetic countersunk screw and nut 12 with which a nonmagnetic retaining member 11 is fixed is loosened, the permanent magnet 10 is turned by 180° and the retaining member 11 is fixed again. Since the putter head 1 is made of a nonmagnetic material just as the nonmagnetic retaining member 11, the putter head 1 is not magnetized even though the permanent magnet 10 is equipped in the putter head 1. And a position of the permanent magnet 10 which is turned by 180° is away from the iron magnet 9 on the lower portion of the sheet pendulum 6 by distance sufficient not to affect the iron weight 9 by the magnetic attracting force of the permanent magnet 10. Thereby the sheet pendulum 6 is free from the magnetic force, and is allowed to rotate freely.

According to the present invention, provided is a putter which does not cause an optical illusion which tends to occur when a golfer putts a ball to a target.

Even when a golfer places a putter head at his own lie angle in a normal way at address, the golfer is allowed to check whether his sighting line is vertical, therefore, any type of golfers can use the putter without feeling inconvenience.

And, when lighting and light-collecting function is provided, the golfer can check precisely how a sheet pendulum is in the putter head.

DETAILED DESCRIPTION OF THE PREFERRED EMBODIMENTS

Figure 19:
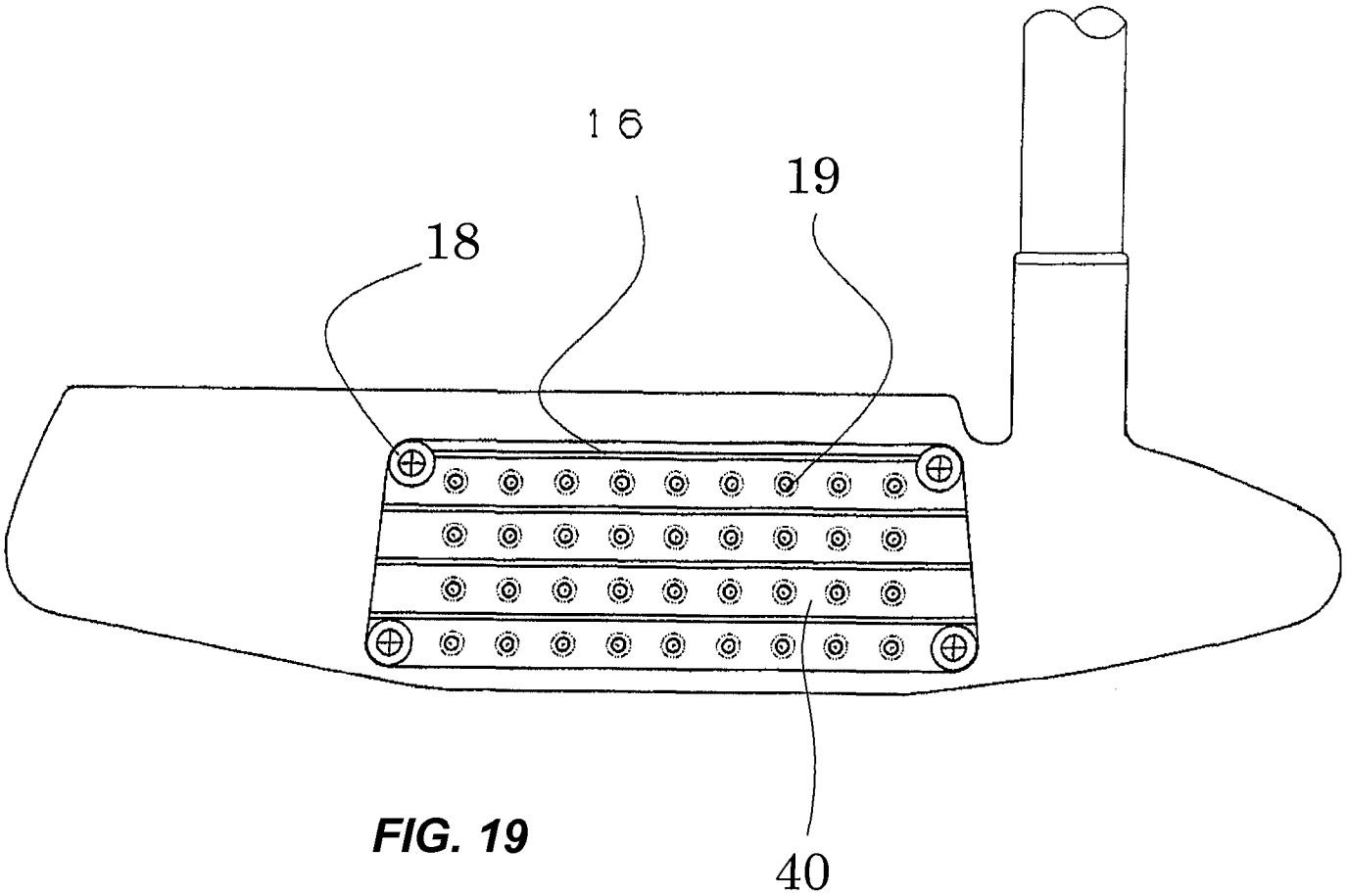
FIG. 19 is a view showing slits formed in the hitting surface and a bearing for facilitating spin in a forward direction.
Figure 20:
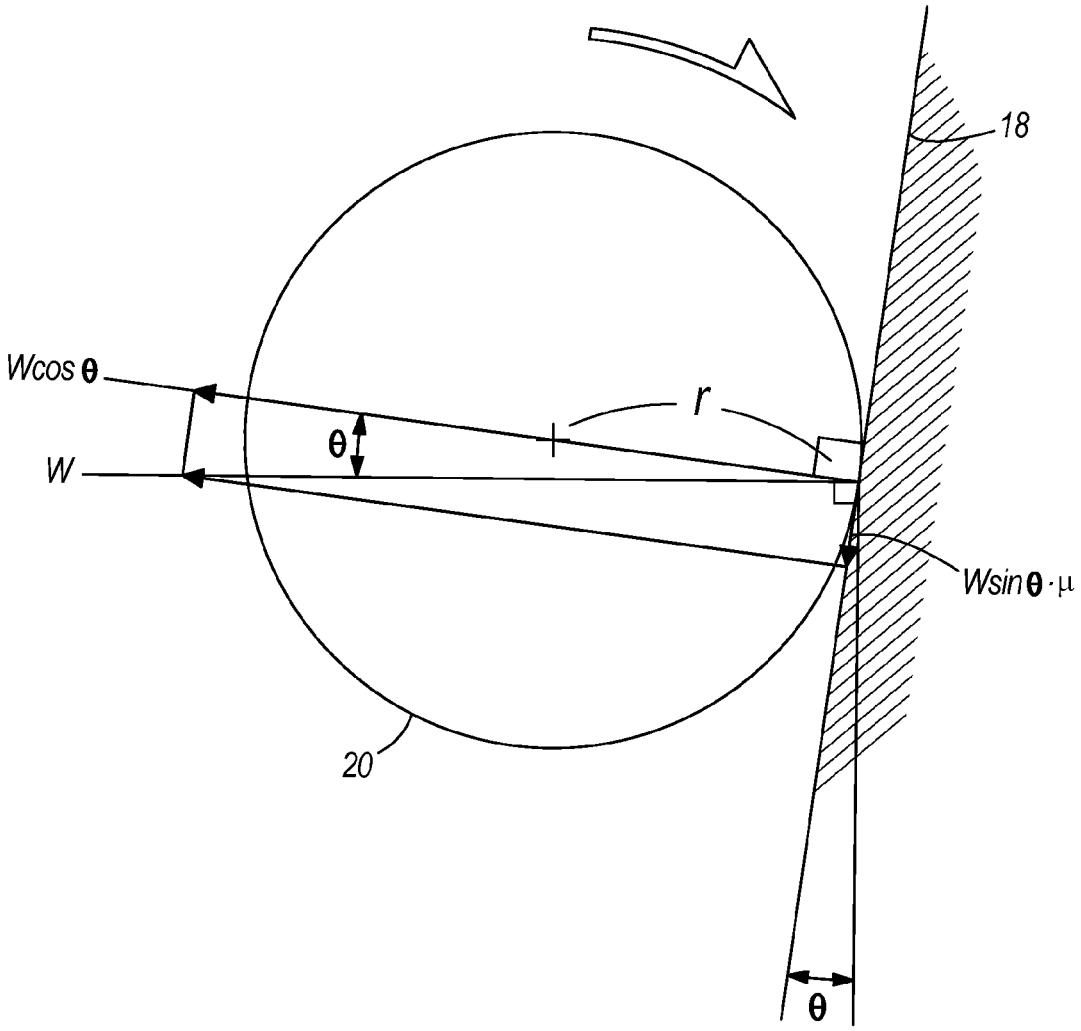
FIG. 20 is a plan view showing a mechanism for causing sidespin by the hitting surface.

According to an aspect of the present invention, a putter comprises a putter head 1 made of brass (JIS CAC406), a still shaft 2 of 32 inches (approx. 81 cm) in length attached to the putter head 1 and a rubber grip of 10 inches (approx. 25 cm) in length (not shown). A sheet pendulum body or thin-plate pendulum body 6*a* is made of aluminum and 0.8 mm in thickness to minimize inertia force at impact. A rotation shaft 8 is made of stainless steel and 0.6 mm in diameter. An iron weight 9 is fixed to the sheet pendulum or thin plate pendulum 6 with iron screws of M1.6 For a hitting surface of the putter head 1, multilayered oil-impregnated metal material is used. A hitting surface member made of the multilayered oil-impregnated metal material is produced as follows. Powders of phosphor-bronze alloy and lead bronze alloy are penetrated to a stainless plate of 2 mm in thickness as a base material by solid-state diffusion to produce porous crystal layers, then polyamide and molybdenum disulfide are welded and impregnated to the porous crystal layers, thereby a plate member 18 of the multilayered oil-impregnated metal member is obtained (refer to reference numeral 17 of FIG. 18 and reference numeral 40 of FIG. 19). Then, a plurality of lateral slits of 0.5 mm width are formed parallel with each other in the plate member for facilitating spin of a ball in a forward direction. For fixture of the sheet pendulum 6, a permanent magnet 10 of 2.0 $mm^3$ in size is used. A test was conducted with this putter. In the test, a golfer putted a ball in a straight line to a target 4 m away from a start spot, and he had 61 successful putts out of a hundred putts with the putter of the present invention. On the contrary, with conventional putters, the golfer had about 20% of successful putts at average. Comparing the test results, the function of the putter of the present invention is ensured. It is obvious that the sheet pendulum 6 is effective in aiming way to the target accurately. Moreover, as will be appreciated from FIG. 20, in the putter of the present invention, friction resistance of the hitting surface is reduced without reducing spin in the forward direction, thereby the putter of the present invention is found very effective in reducing sidespin resulting from pushed shot or hooked shot.

Figure 18:
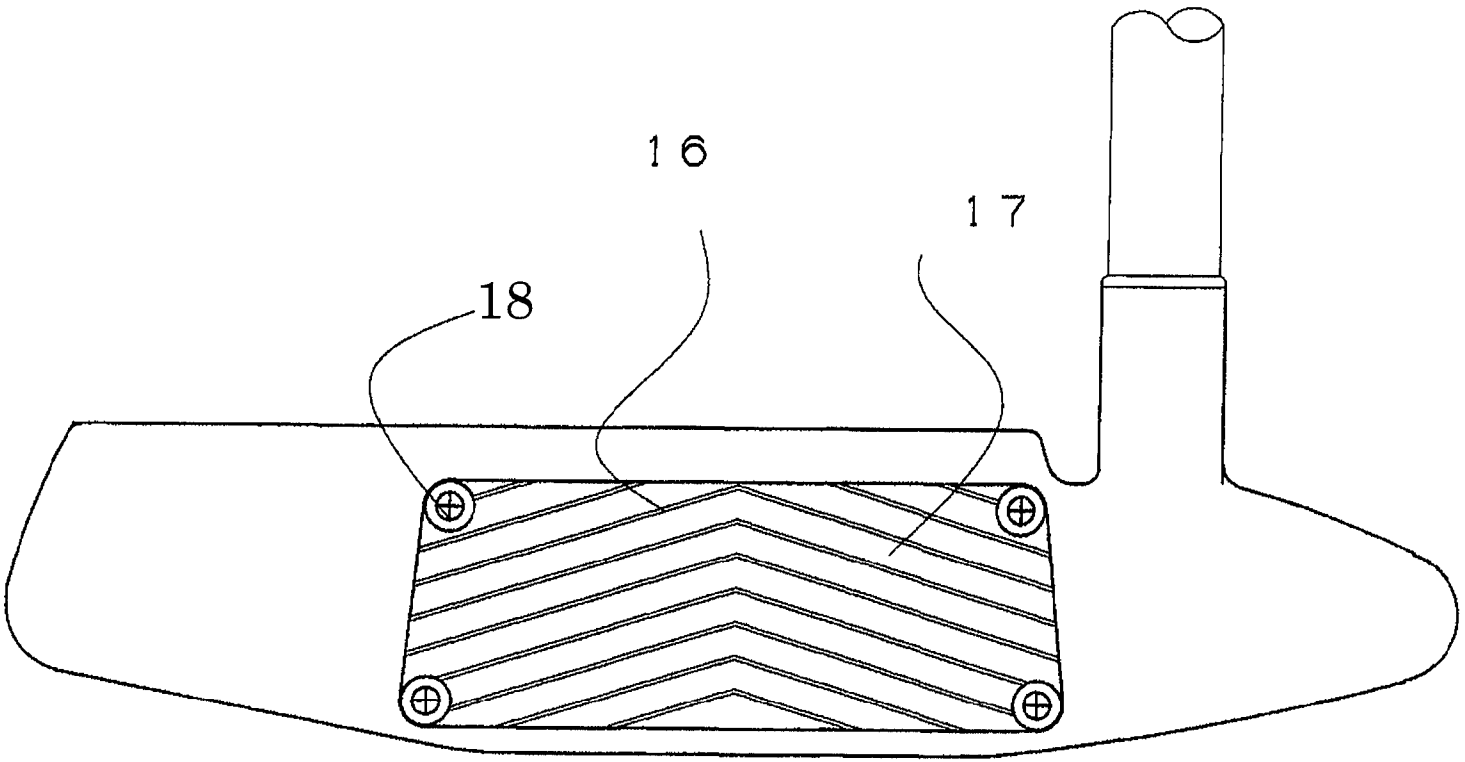
FIG. 18 is a view showing slits formed in a hitting surface made of an oleoresin for facilitating spin in a forward direction.

By the way, in FIG. 18, a hitting surface member or a plate member 17 made of oil-impregnated metal or oleoresin, oil-impregnated composite or multilayered metal, or composite or multilayered oleoresin is fixed to the putter head 1 with use of screws 18, and slits 16 of an inverted V shape are provided in the plate member 17. And, in FIG. 19, ball bearings 19 are provided on a plate member 40 and four slits 16 are provided in the plate member 40. The plate member 40 may be made of oil-impregnated metal or oleoresin, oil-impregnated composite or multilayered metal, or composite or multilayered oleoresin, or may be made of stainless steel.

Compared to a hitting surface of a conventional putter which is made of urethane elastomer, a friction coefficient is reduced by 22% on the hitting surface of the putter of the present invention.

The above has led to reduction of sidespin by 22% (refer to rotation by $W \sin \theta \cdot \mu$ in a direction of an outline arrow).

The relationship between the material of the hitting surface and the friction coefficient $\mu$ is as follows.

| Material of surface of ball | Urethane elastomer | Friction coefficient $\mu$ |
|---|---|---|
| Material of hitting surface of conventional putter | Urethane elastomer | 0.32 |
| Multilayered oil-impregnated metal of putter of the present invention | Stainless base material | 0.071 |
| Ball bearing | Bearing steel (JIS SUJ2) | 0.018 |

Figure 1:
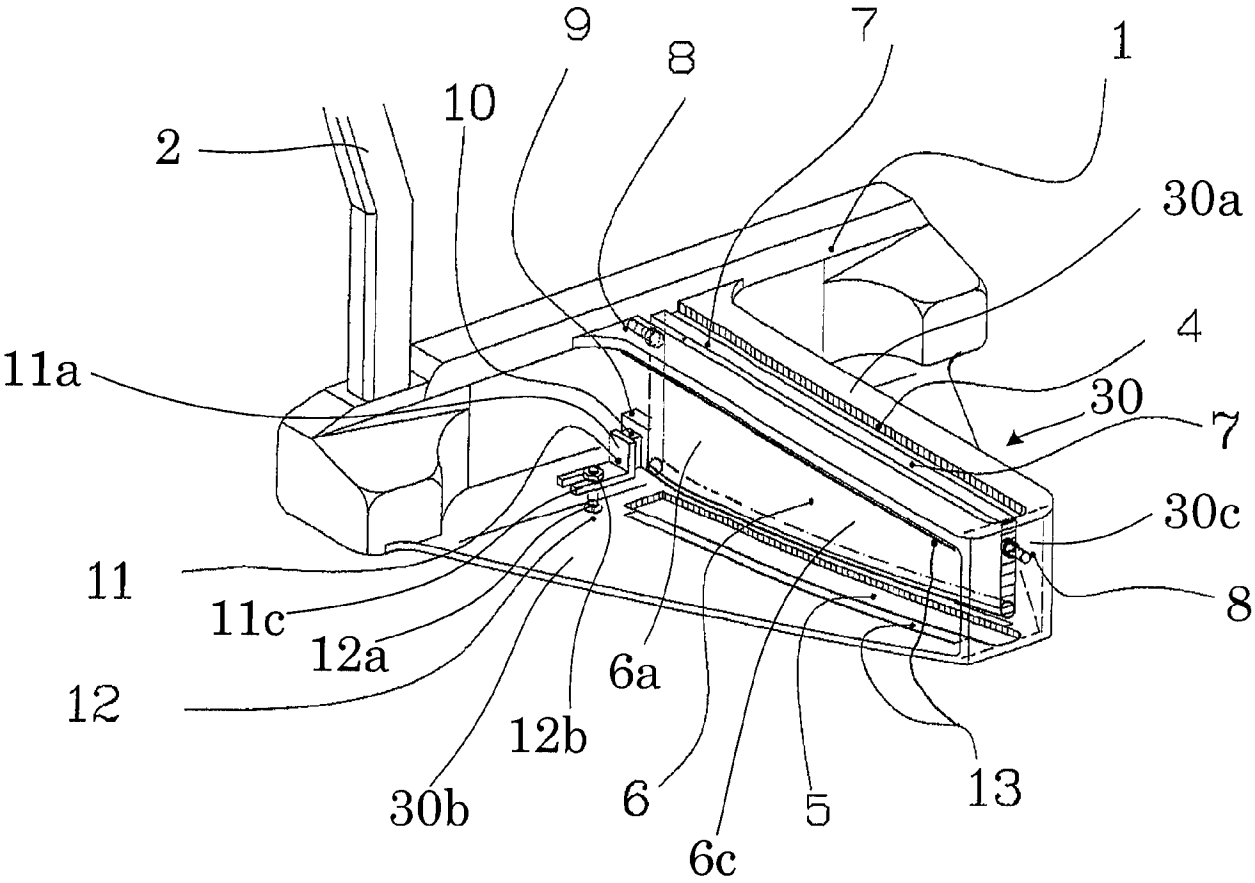
FIG. 1 is an overall view of a putter head in which a sheet pendulum is fixed with a magnet and a lighting reflector is provided

With reference to FIG. 1, the putter head 1 is provided with a cover 30 on a rear surface of the putter head 1, namely, on a surface opposite to a hitting surface of the putter head 1. The cover 30 integrally has an upper cover plate 30*a* which is located above the thin-plate pendulum body 6*a* or at a position of an upper end of the thin-plate pendulum body 6*a*, a lower cover plate 30*b* which is located below the thin-plate pendulum body 6*a*, and a connecting portion 30*c* which connects a leading end portion of the upper cover plate 30*a* and a leading end portion of the lower cover plate 30*b*. The cover 30 is attached to the putter head 1 by fixing a base portion of the upper cover plate 30*a* on an upper portion of the rear surface of the putter head 1 and fixing a base portion of the lower cover plate 30*b* on a lower portion of the rear surface of the putter head 1. The upper cover plate 30 is provided with a first slit 4 extending straight from a base end to a leading end thereof, and the lower cover plate 30*b* is also provided with a second slit 5 having the same width as the first slit 4 and extending straight from a base end portion to a leading end thereof. When the putter head 1 is placed horizontally on the green, that is, the putter head 1 is placed on the green at a lie angle d (refer to FIG. 3) of 0°, the first slit 4 and the second slit 5 are vertically aligned, or a straight line extending through an edge on one widthwise end of the first slit 4 and an edge on one widthwise end of the second slit 5 is vertical, while a straight line extending through an edge on the other widthwise end of the first slit 4 and an edge on the other widthwise end of the second slit 5 is also vertical. For example, the first slit 4 and the second slit 5 have wide-width.

The sheet or thin-plate pendulum 6 comprises the sheet or thin-plate pendulum body 6*a* which is a plate having a thickness smaller than the width of the first and the second slits 4, 5, and rotating shafts 8 which are provided on an upper end of the leading end surface and an upper end of the rear end surface of the sheet pendulum body 6*a*, respectively. The sheet pendulum body 6*a* is disposed along the first slit 4 and the second slit 5 with its upper end surface 7 on a widthwise center in the first slit 4. The rotating shafts 8 may be rotatably supported on the rear surface of the putter head 1 and the connecting portion 30*c* of the cover 30, below the first slit 4, and may be fixed to the sheet pendulum body 6*a*. Or, the rotating shaft 8 may be fixed to the rear surface of the putter head 1 and the connecting portion 30*c* of the cover 30, below the first slit 4, and the sheet pendulum body 6*a* may be rotatably supported on the rotating shaft 8. Needless to say, the rotating shaft 8 may be rotatably supported on the rear surface of the putter head 1 and the connecting portion 30*c* of the cover 30, below the first slit 4, and the sheet pendulum body 6*a* may be rotatably supported on the rotating shaft 8.

A metal (for example, iron) weight 9 is fixed on a lower portion of the base end is surface of the sheet pendulum body 6*a*.

An L-shaped retaining member 11 is fixed on an upper surface of a base end portion of the lower cover plate 30*b*, and the retaining member 11 includes a vertical portion 11*a* and a horizontal portion 11*c*. A permanent magnet 10 is fixed on the vertical portion 11*a* thereof. The horizontal portion 11*c* thereof has a bifurcated portion or U-shaped portion and the retaining member 11 is fixed on the lower cover plate 30*b* by passing a bolt 12*a* through the bifurcated portion and screwing a nut 12*b* to the bolt 12*a* (refer to reference numeral 12). A space between the retaining member 11 and the thin-plate pendulum body 6*a* or a position of the permanent magnet 10 can be adjusted by sliding the U-shaped portion of the horizontal portion 11*c* of the retaining member 11 with respect to the bolt 12*a*. Here, the thin-plate pendulum body 6*a* is attracted to the retaining member 11 by a permanent magnet 10 which is mounted on the retaining member 11, thereby the thin-plate pendulum body 6*a* is fixed at the desired or predetermined angle. And, the permanent magnet 10 is moved away from the weight 9 by rotating the retaining member 11 half-turn (refer to FIG. 8).

On an under surface or inner surface of the upper cover plate 30*a*, a reflector or a light-collecting reflector 13 is provided along both side edges of the first slit 4, while on an upper surface or inner surface of the lower cover plate 30*b*, a reflector or a lighting reflector 13 is provided along both side edges of the second slit 5.

Figure 6:
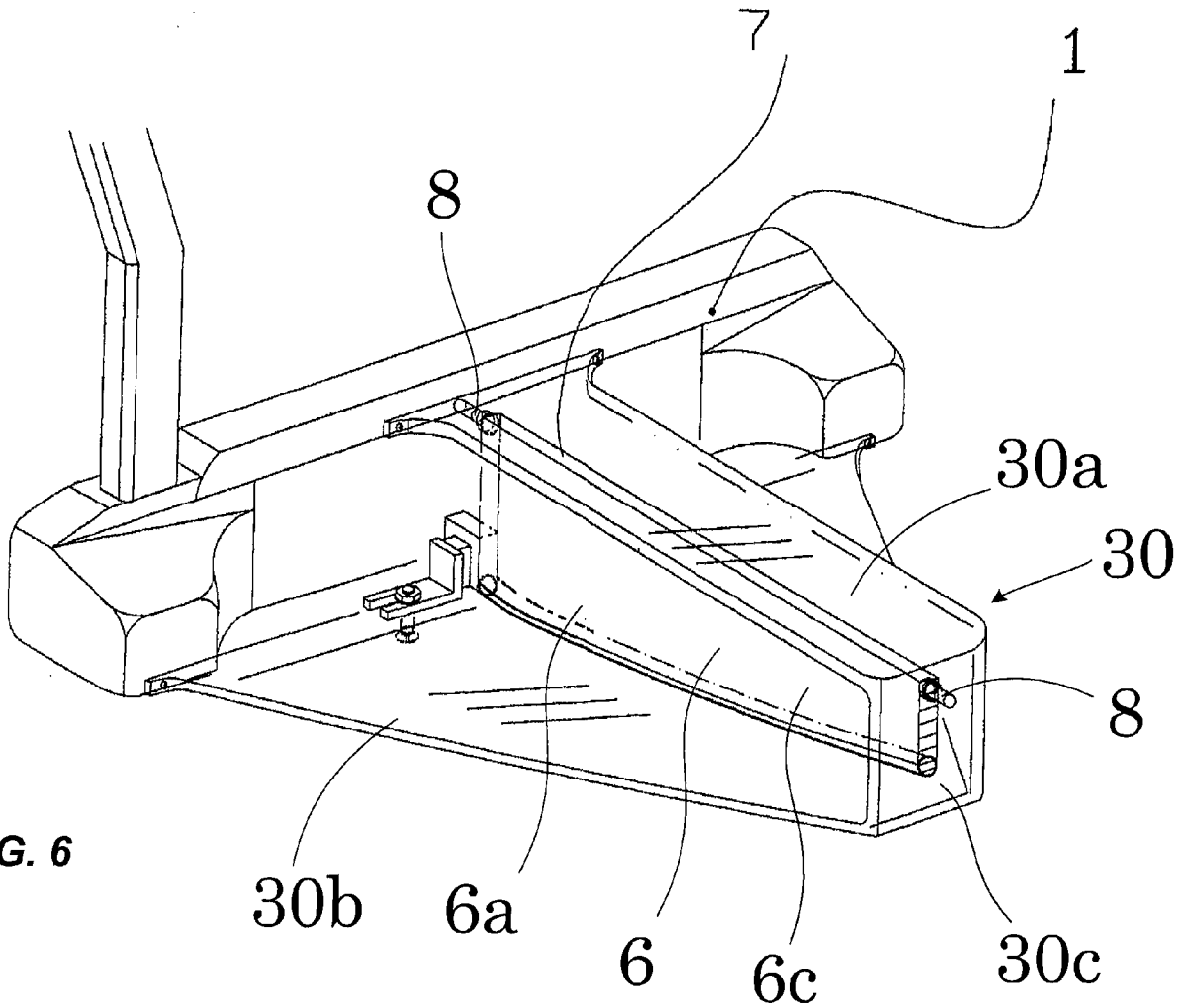
FIG. 6 is an overall view of the putter head which is provided with a reinforced glass or light-transmissive resin plate on an upper side of the sheet pendulum.

In a second embodiment, as shown in FIG. 6, instead of forming slits on the upper cover plate 30*a* and the lower cover plate 30*b*, the cover 30 is made of a light transmissive resin plate, specifically, an acryl plate of 3 mm in thickness. The cover 30 is mounted to the putter head 1 by means of six pieces of stainless-steel screws of M1.6 which is screwed into an internally threaded hole in the putter head 1.

Figure 7:
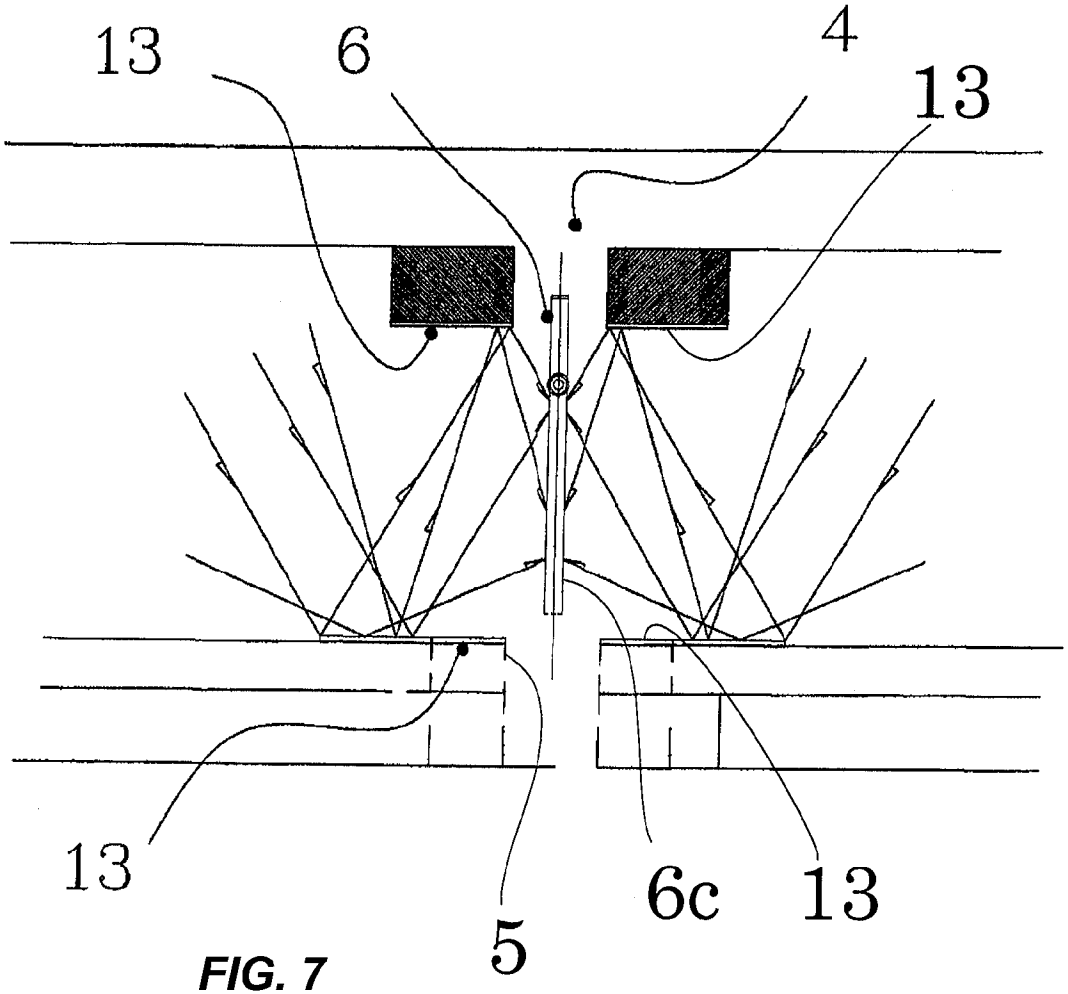
FIG. 7 is a view showing a light-collecting reflector and a light reflector on upper and lower sides.

In this manner, provided is the putter head 1 for allowing for seeing the sheet pendulum 6 from the above although the lighting reflector and the light-collecting reflector 13 as FIG. 7 is not provided.

Figure 4:
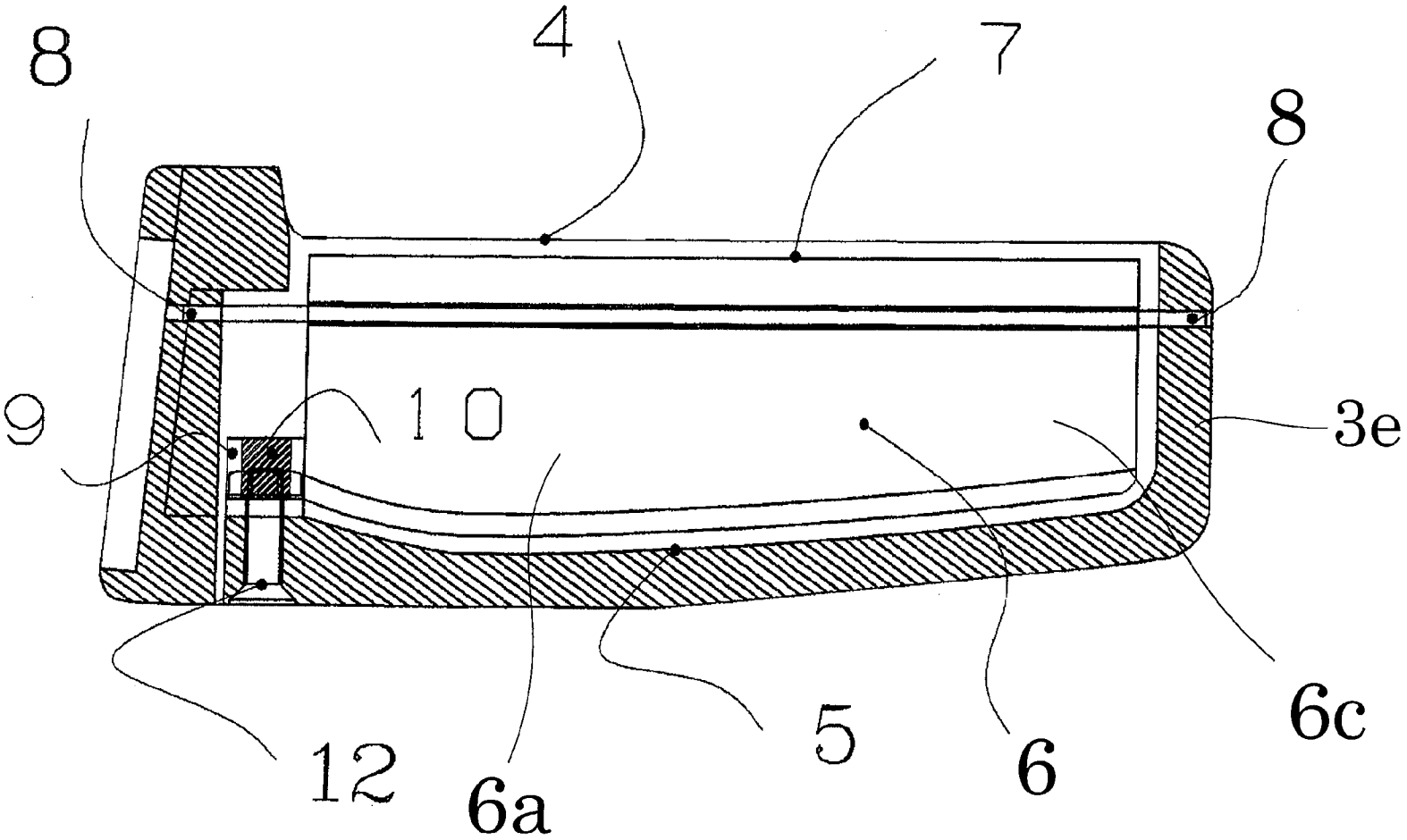
FIG. 4 is a side sectional view of the putter head.
Figure 5:
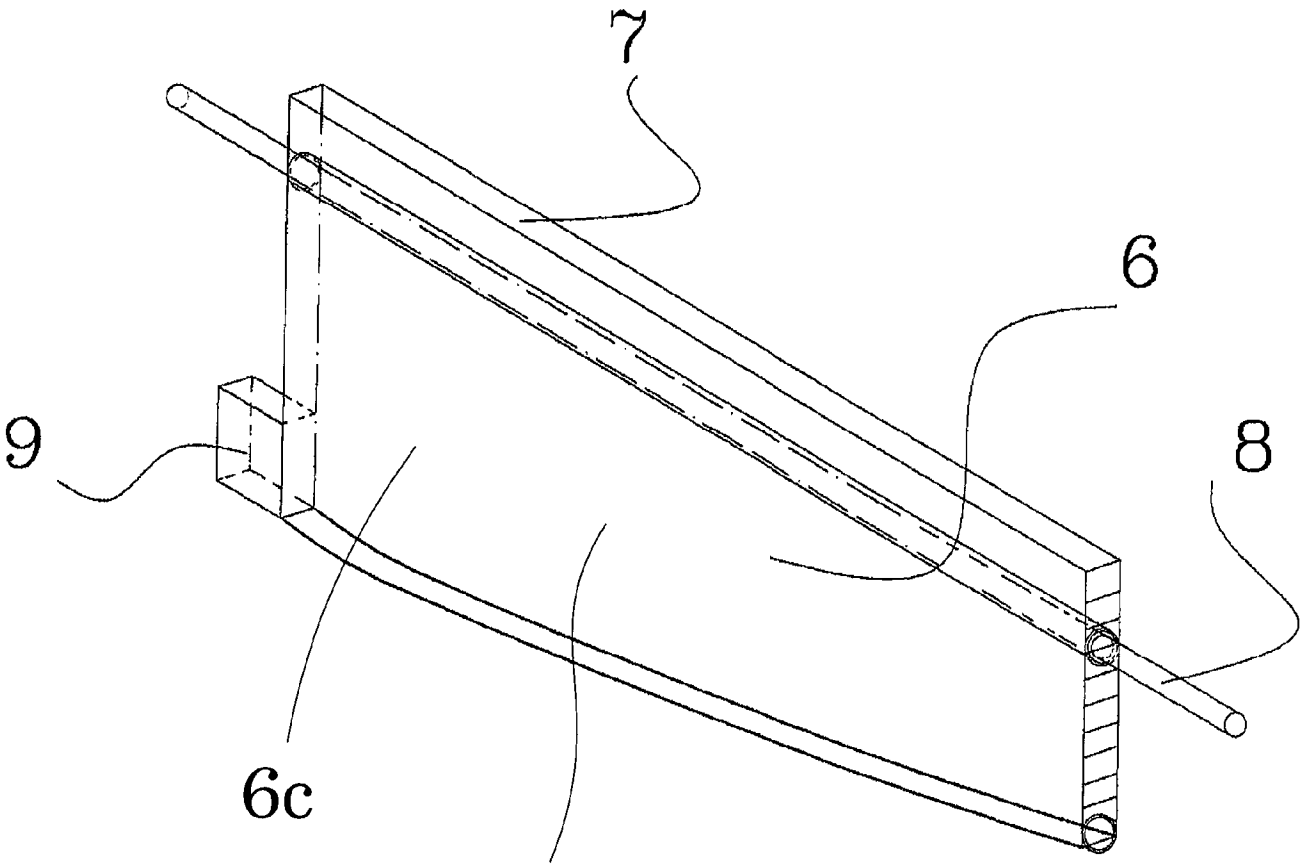
FIG. 5 is a view showing the sheet or thin-plate pendulum.
Figure 8:
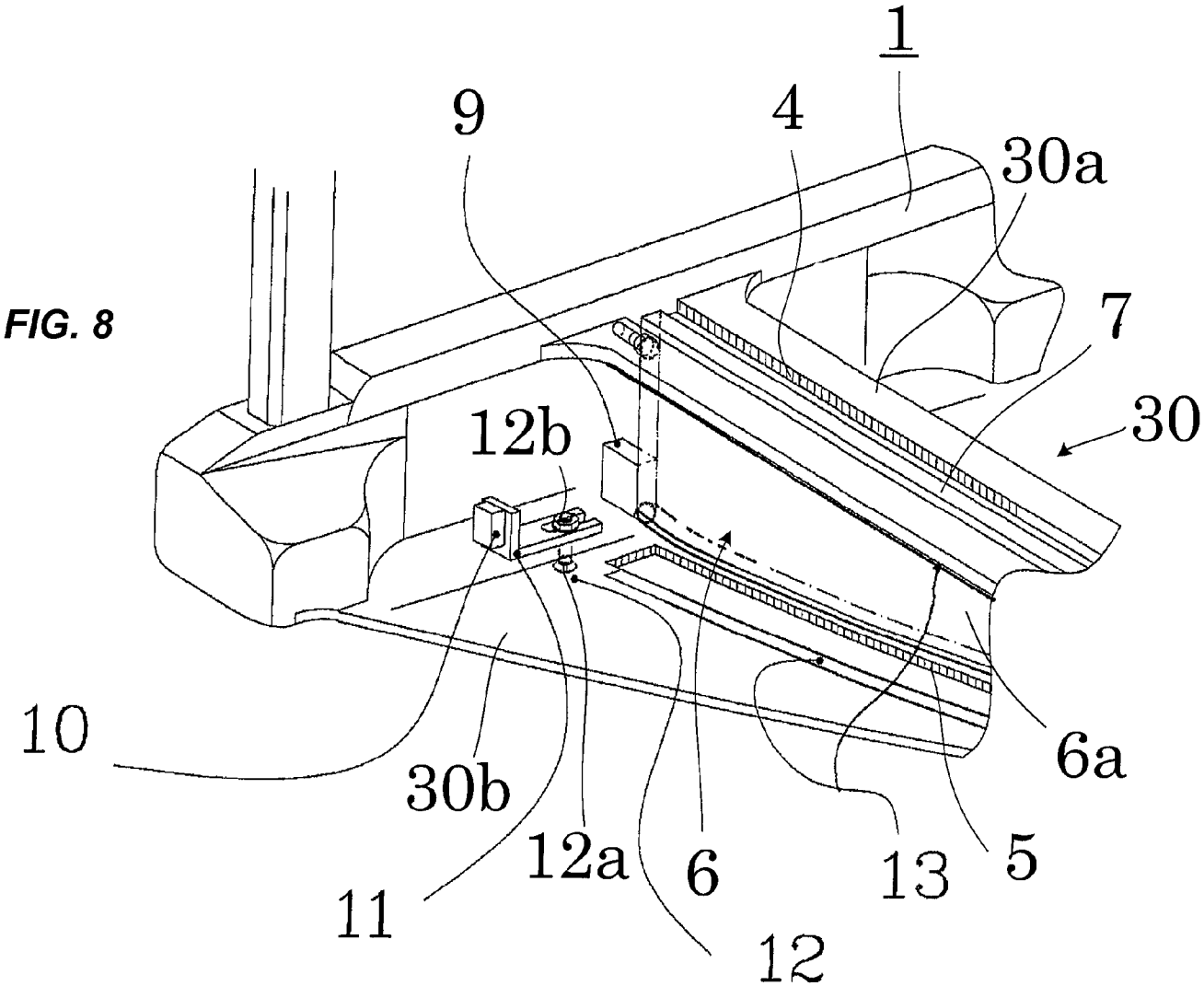
FIG. 8 is a view showing the sheet pendulum which is free from a magnet force therefore is not affected by a magnetic attractive force.
Figure 9:
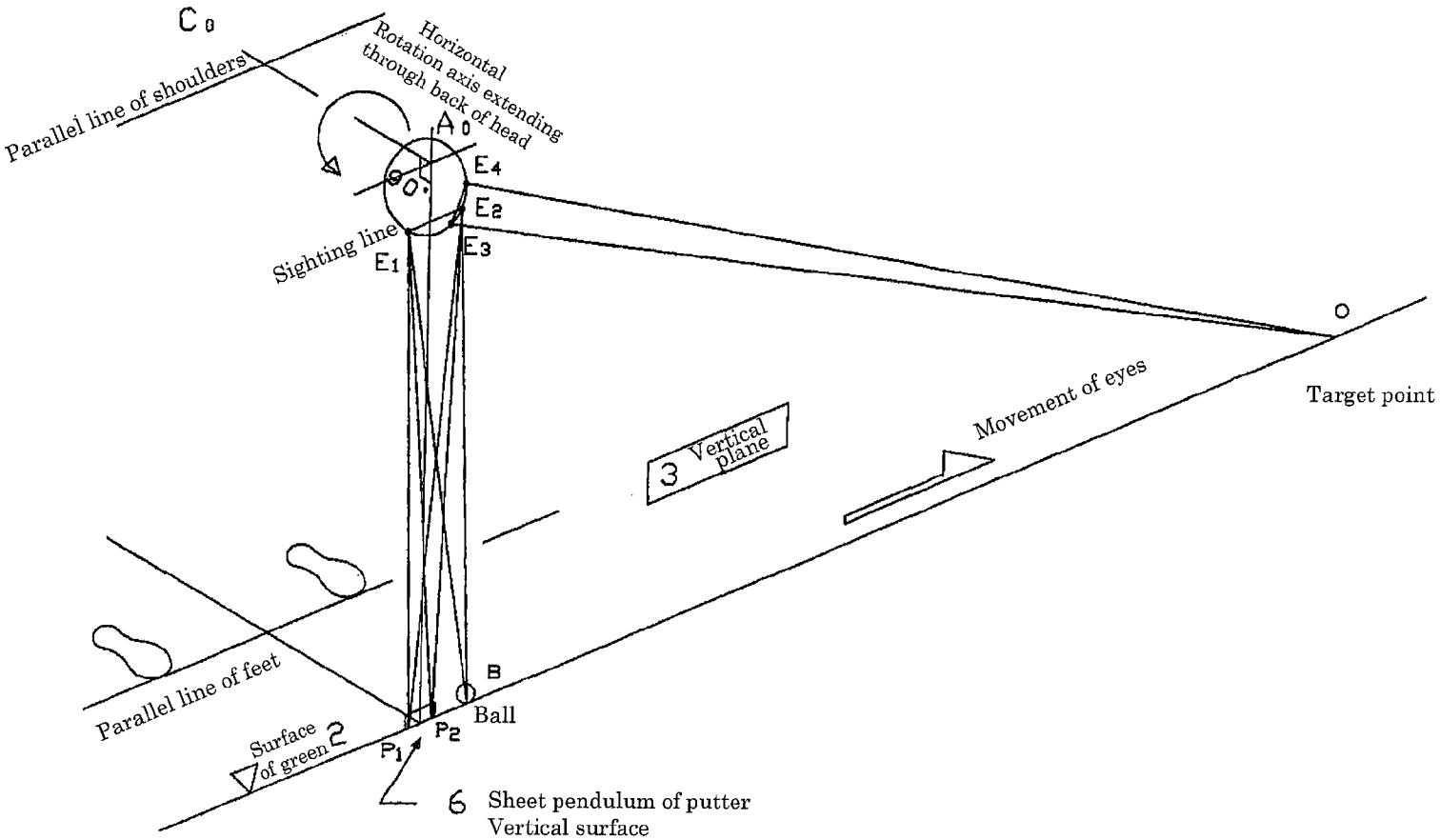
FIG. 9 is a view showing the relationship among a rotation axis, a motion of a golfer's eyes, a vertical surface of the putter head, and a target point.
Figure 10:
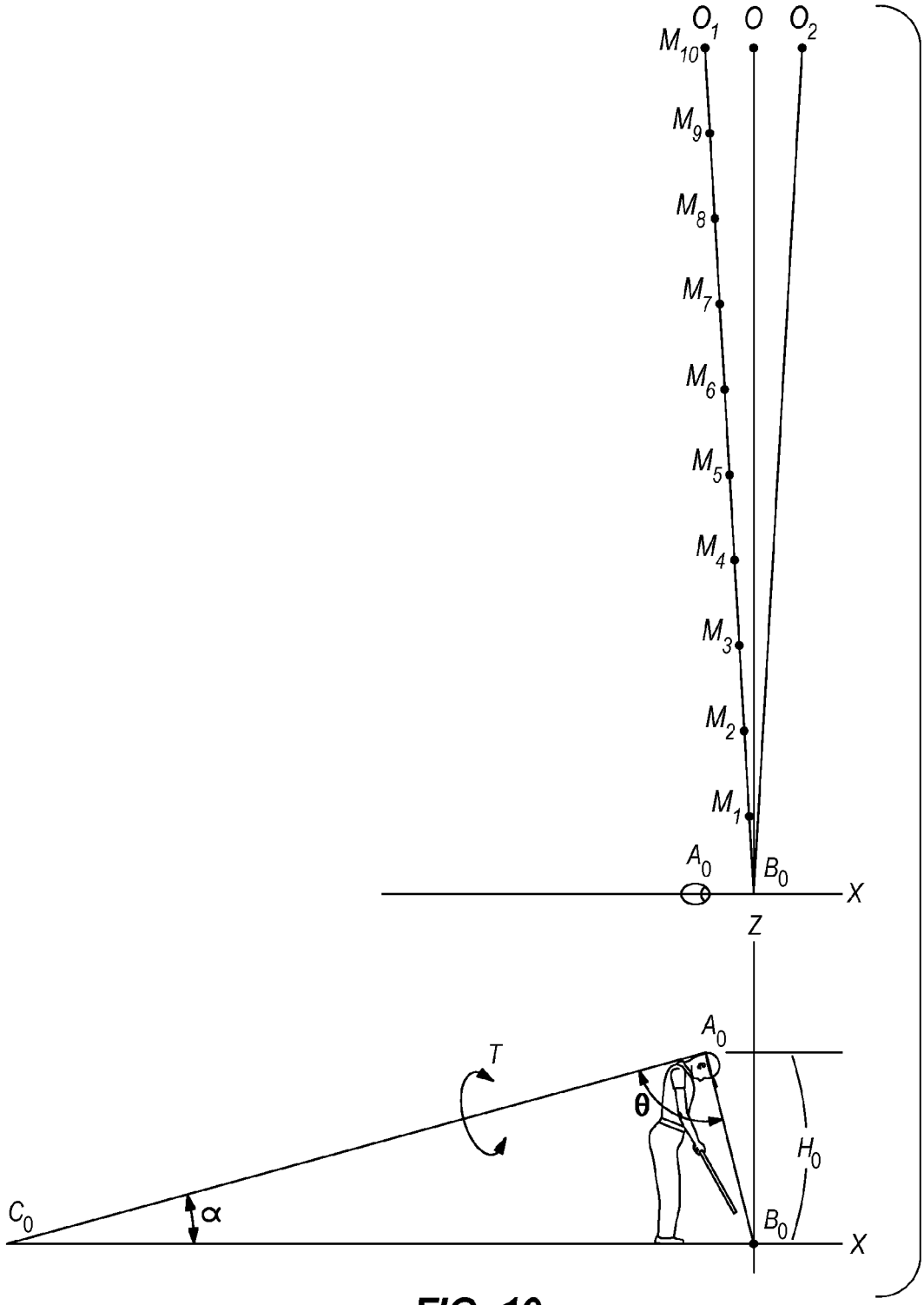
FIG. 10 shows views for explaining a case that the golfer's eyes track a curved line toward an incorrect direction by an optical illusion.
Figure 11:
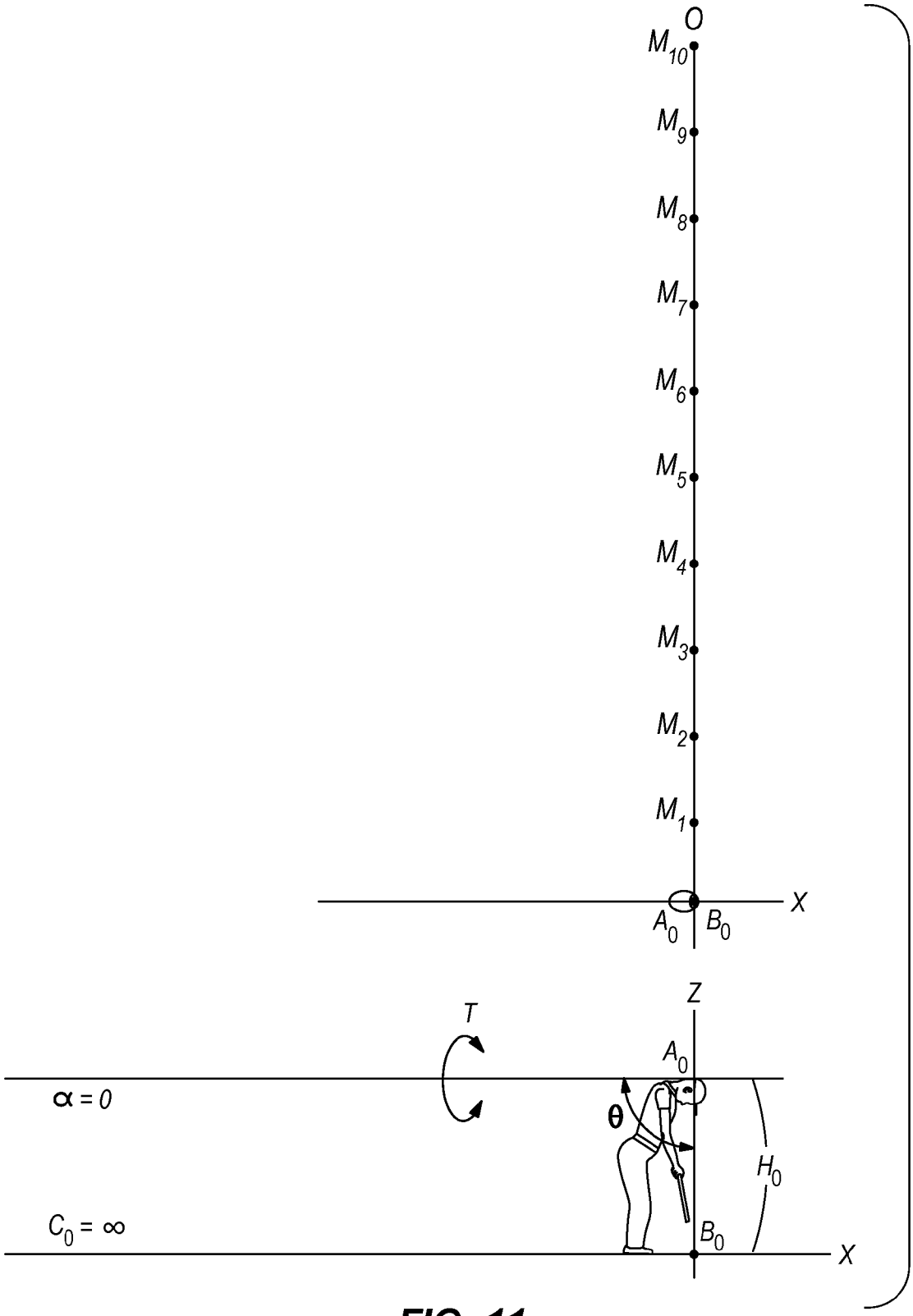
FIG. 11 shows views for explaining a case that the golfer's eyes track a straight line toward a target.
Figure 12:
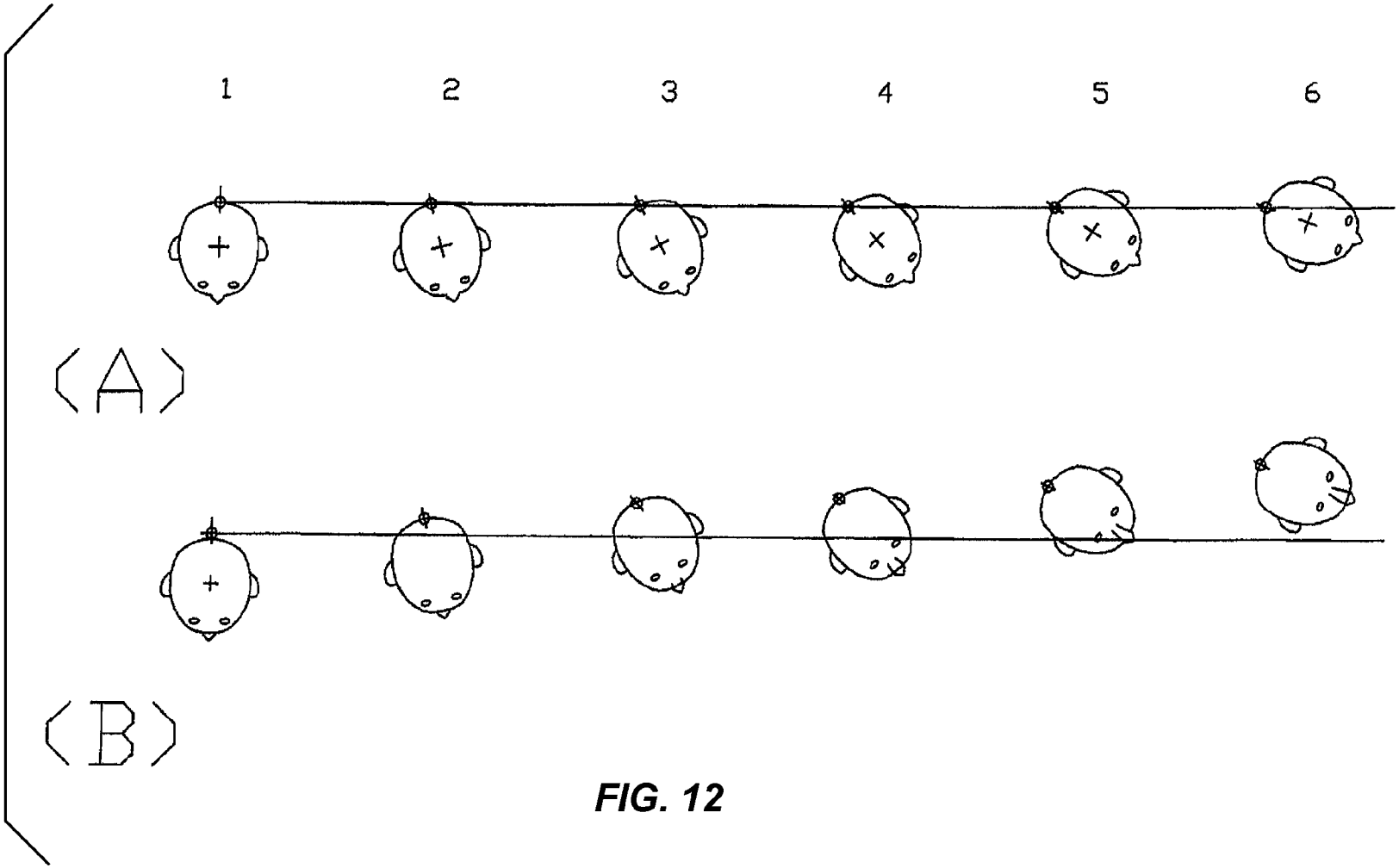
FIG. 12 shows views for explaining how movement of a golfer's sighting line is affected by inclination of a rotation axis.
Figure 13:
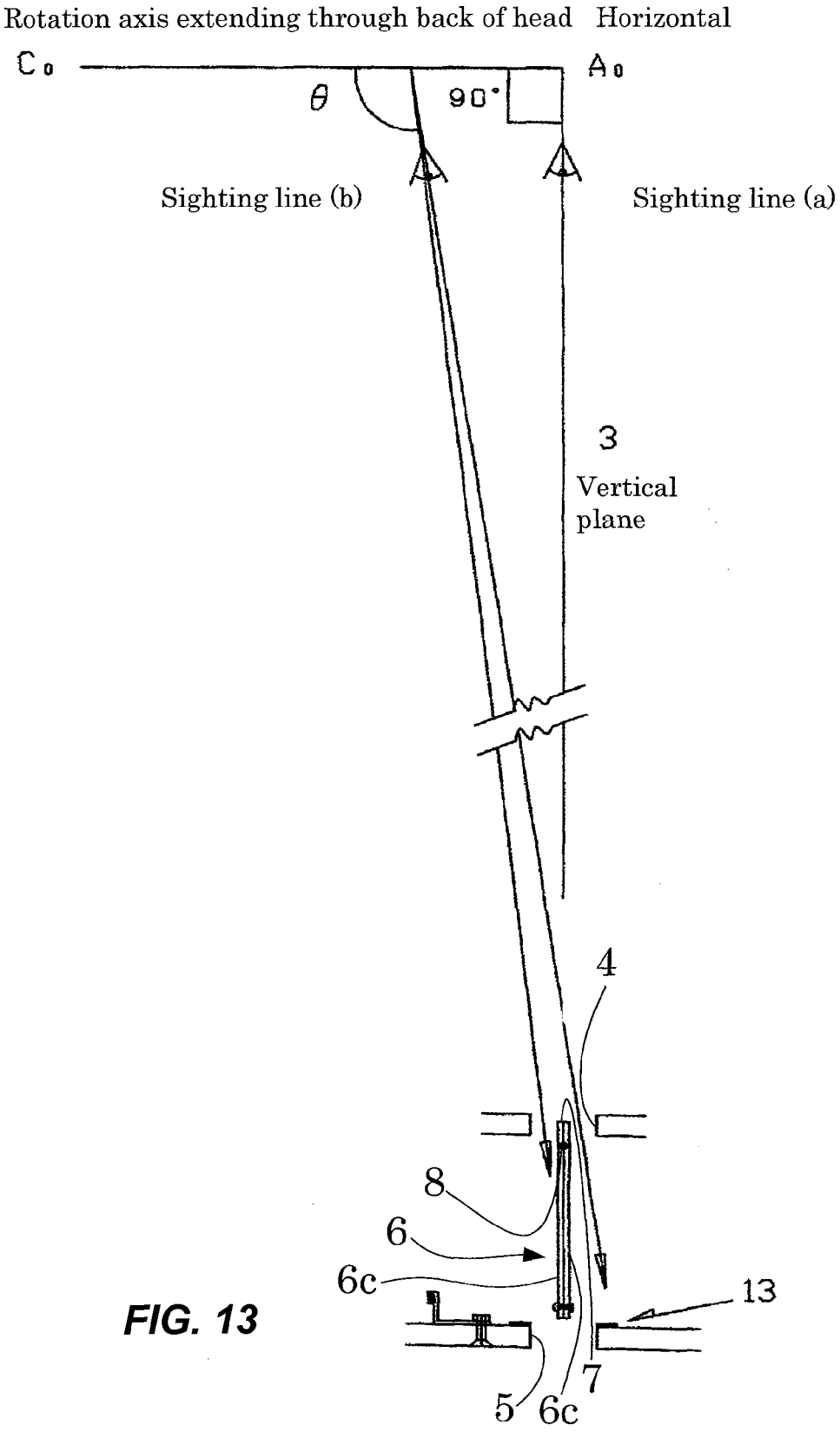
FIG. 13 is a view showing a relationship between the sheet pendulum and an elevation/depression angle defined by the rotation axis and the golfer's sighting line.
Figure 14:
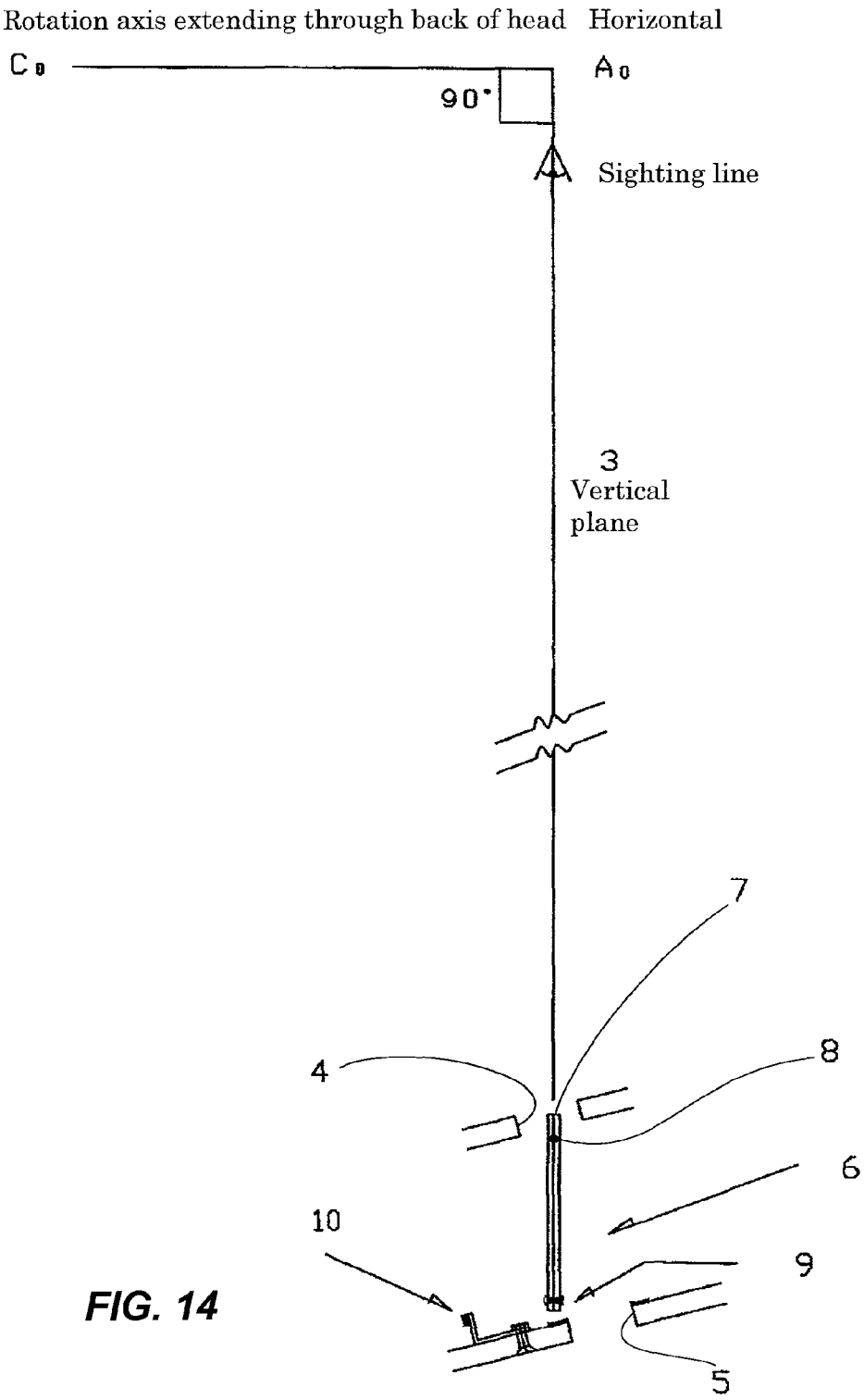
FIG. 14 is a view showing a relationship between the sheet pendulum rotating freely and the golfer's sighting line in a case of a forward hand press.
Figure 15:
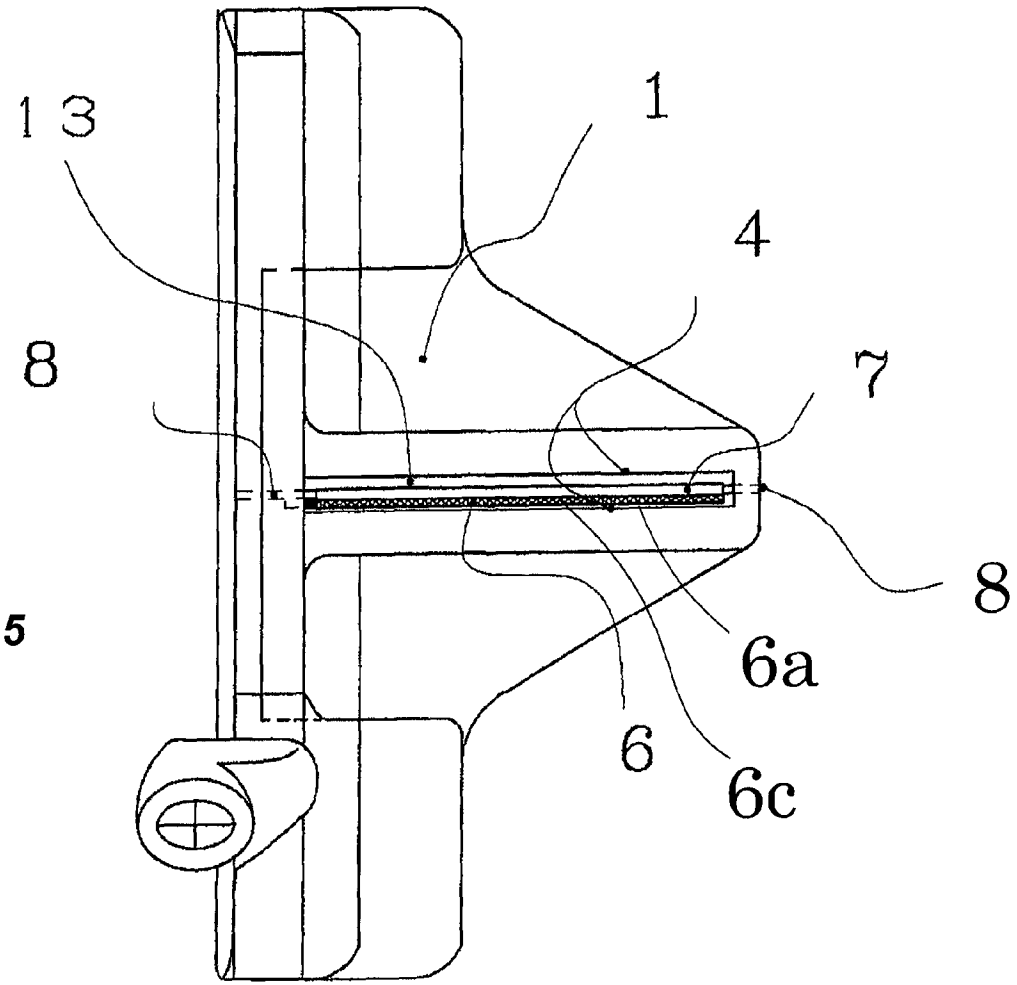
FIG. 15 is a view showing how a light reflector and a side wall of the sheet pendulum are seen when a first slit is viewed obliquely from the above.
Figure 16:
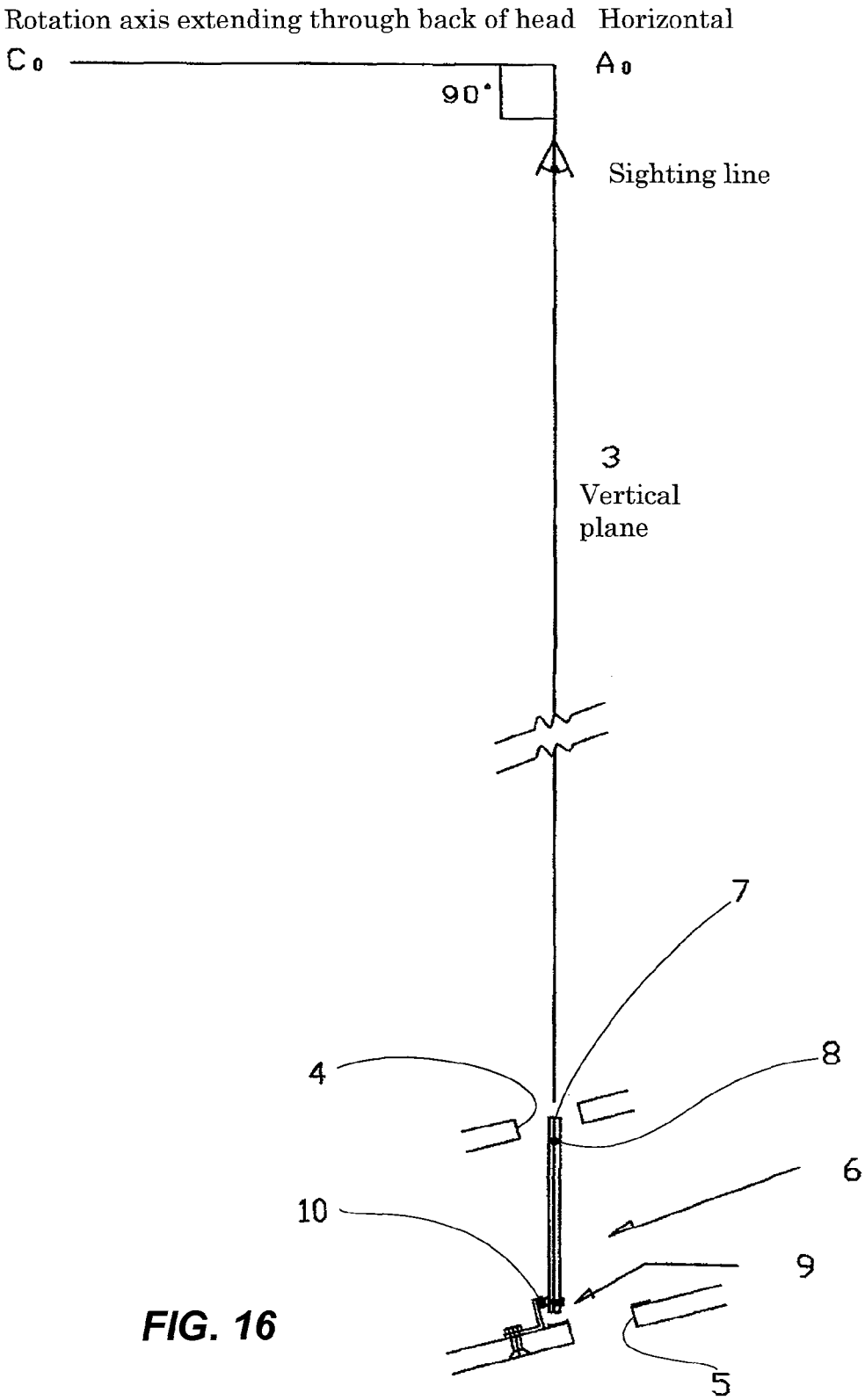
FIG. 16 is a view for explaining the relationship between the sheet pendulum and the golfer's sighting line when the sheet pendulum is fixed so as to correspond to a lie angle.

FIGS. 4 and 5 show another embodiment of the sheet pendulum 6 according to the present invention. When the sheet pendulum 6 in FIG. 5 is viewed from directly above, only the upper surface 7 of the sheet pendulum 6 is visible as a slim line, but side walls 6*c* of the sheet pendulum 6 are not visible. According to FIGS. 4 and 5, the single rotating shaft 8 rotatably passes through a upper portion of the sheet pendulum 6, and the rotating shaft 8 is supported below the first slit 4 by the rear surface of the putter head 1 and the connecting portion 30*c* of the cover 30 at both ends thereof. The rotating shaft 8 may be supported at only one end thereof in a cantilever manner. The iron weight 9 is also provided on the sheet pendulum 6. Now, the function of the putter head 1 including the lighting reflector 13 on the both side edges of the second slit 5 is explained with reference to FIG. 7. As shown in FIGS. 1, 7, 8, the lighting reflectors 13 are provided on both side edge portions of the second slit 5. For example, a light incoming from lateral side first shines on the reflector 13 on the lower portion. For example, the light incoming at a large angle is reflected on the reflector 13 and shines directly the side surface 6*c* of the sheet pendulum 6. Similarly, a light incoming at a small angle is reflected on the reflector 13 on the lower portion, and then reflected on the light-collecting reflector 13 on the upper portion, and then shines the side surface 6*c* of the sheet pendulum 6. This arrangement allows a golfer to easily check the side surface 6*c* of the sheet pendulum 6 in dim light with rain.

Figure 2:
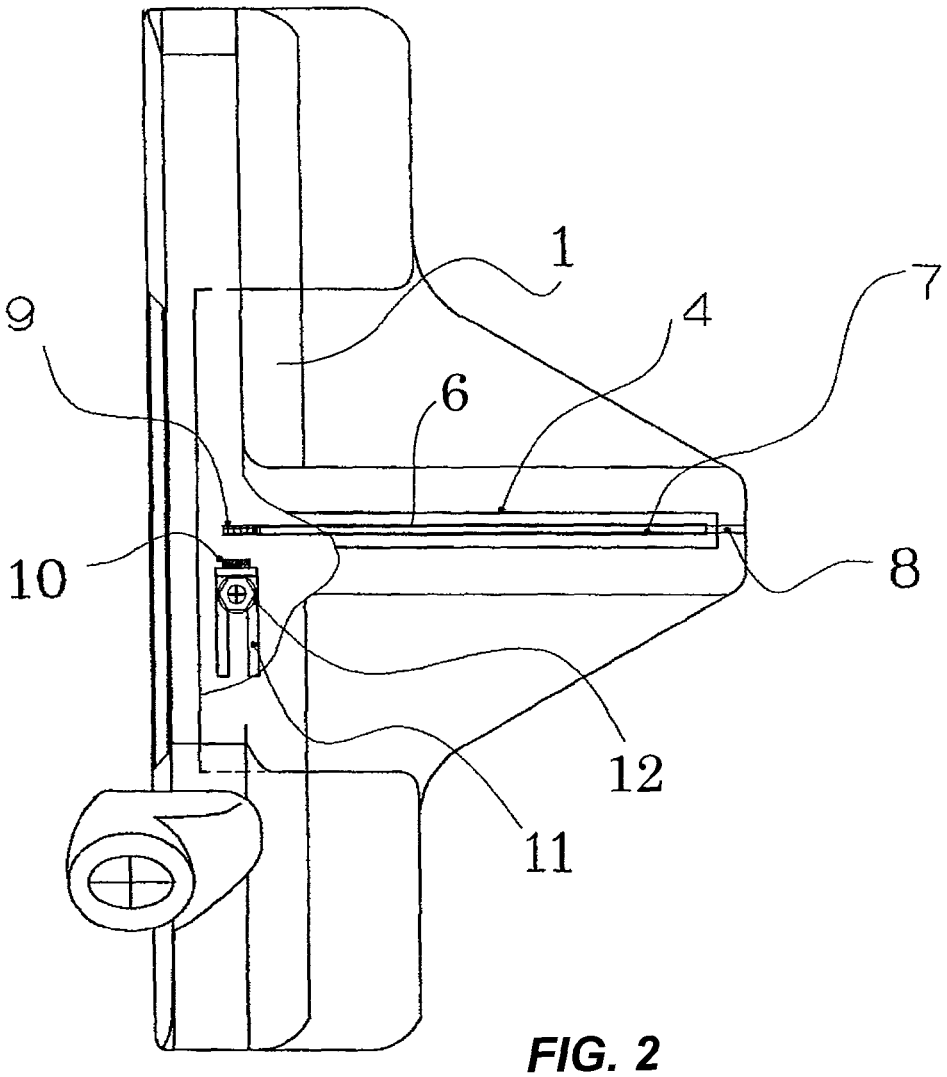
FIG. 2 is a partly-broken plan view of the putter head, showing a position of a permanent magnet before a weight of the sheet pendulum is fixed.
Figure 3:
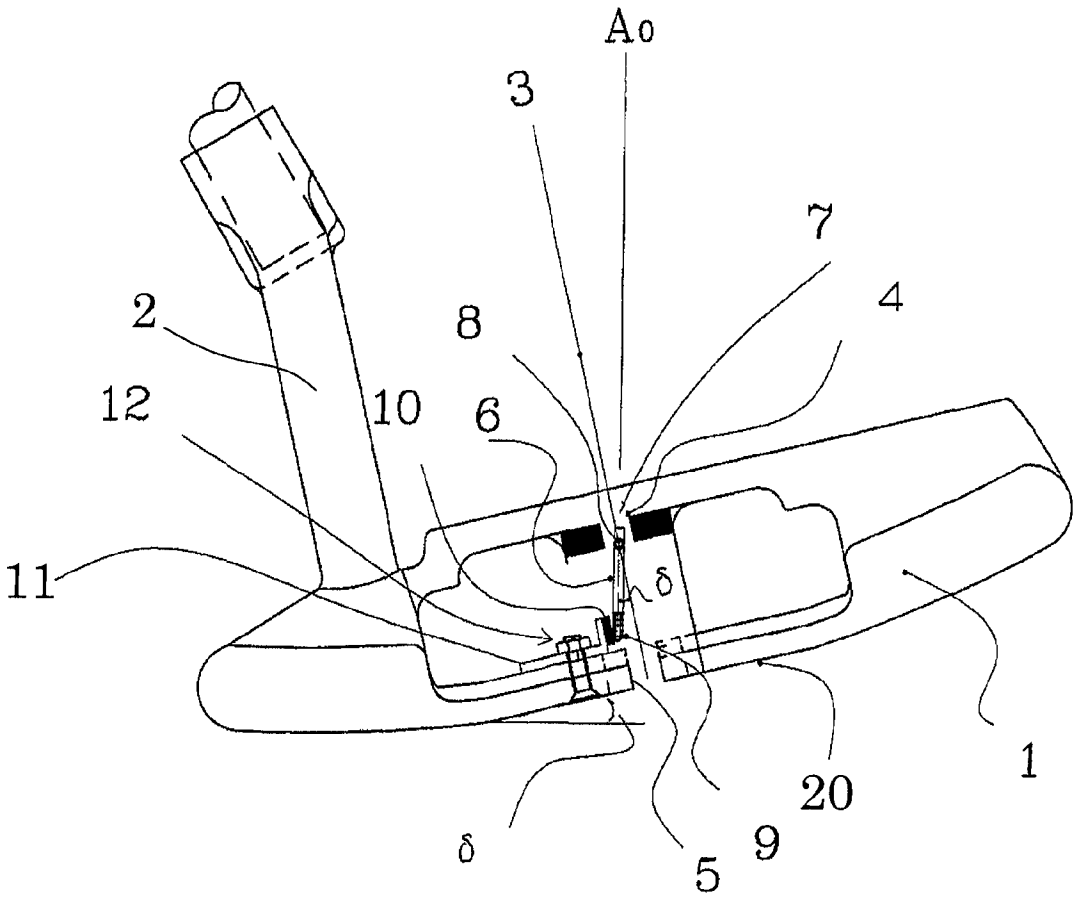
FIG. 3 is a sectional view of the putter head, viewed from back side, where the sheet pendulum is fixed and a golfer takes his address with a forward hand press.

In FIGS. 1, 2 and 3, the sheet pendulum 6 can be fixed at a desired angle d. This arrangement is adapted for the case a golfer places a putter head 1 at his own lie angle with a forward hand press. In FIG. 8, the function of a stopper is not used. By rotating the permanent magnet 10 half turn, the iron weight 9 is free from magnetic attracting force, allowing the sheet pendulum 6 to rotate freely.

Figure 17:
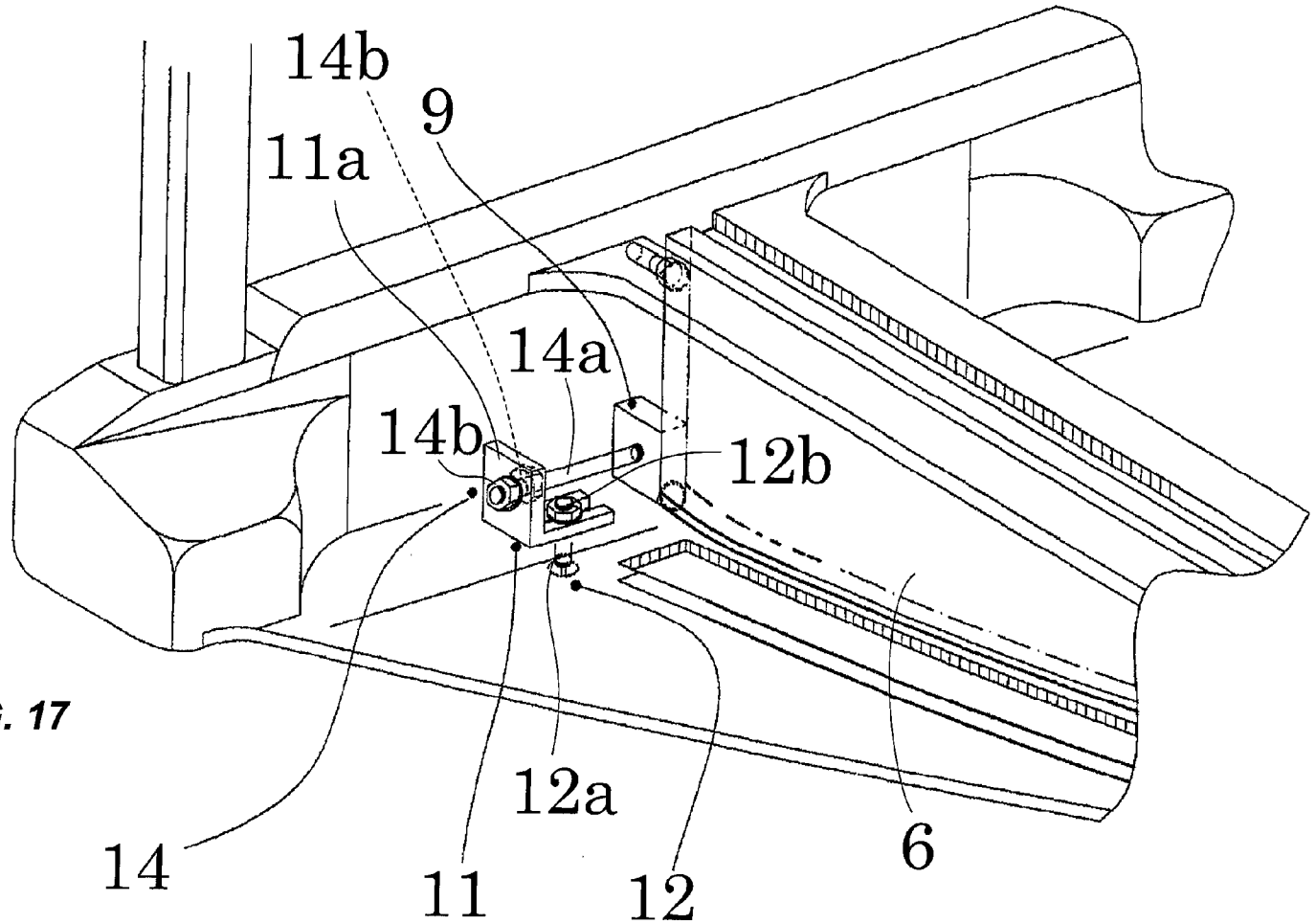
FIG. 17 is a view showing that the sheet pendulum is fixed with use of screws and nuts.

Although the sheet pendulum 6 is fixed with the iron weight 9 attracted to the permanent magnet 10, the magnet 10 may be replaced with screw and nut fixture which serves similar function to the magnet 10, as shown in FIG. 17. The iron weight 9 is internally threaded at the center thereof to form an internally threaded hole screw in the iron weight 9. The retaining member 11 is arranged to the putter head 1 with use of a countersunk screw 12*a* and a nut 12*b*. A through-hole (not shown) is formed in the vertical portion 11*a* of the retaining member 11, the screw 14*a* for fixing the weight 9 is passed through the through-hole and screwed into the internally threaded hole in the iron weight 9. A pair of nuts 14*b* are screwed on the screw 14*a* at both sides of the vertical portion

11*a* (refer to reference numeral 14), thereby the screw 14*a* is attached or positioned with respect to the retaining member 11. Here, turning this screw 14*a* into the internally threaded hole (not shown) of the iron weight 9 to adjust a length of a screw thread portion of the screw 14*a* in the internally threaded hole and positioning the screw 14*a* with respect to the retaining member 11, the sheet pendulum 6 is fixed at a desired or predetermined position or at a desired or predetermined angle. The through-hole of the vertical portion 11*a* is, for example, larger than the screw 14*a* in diameter. In this case, the material for each part may be decided without considering the relation with respect to magnetism, for example, it is does not matter whether a nonmagnetic material or a magnetic material such as an iron is used.

What is claimed is:

1. A putter, comprising a putter head, the putter head, comprising:

a sole surface;

a hitting surface extending upwardly away from the sole surface; and a thin-plate pendulum on an opposite side of the hitting surface;

wherein the thin-plate pendulum has a thin-plate pendulum body having an upper end surface, perpendicular to or generally perpendicular to the hitting surface, and a rotation axis member on the opposite side of the hitting surface, at a position corresponding to a center of the hitting surface, the rotation axis member extending generally perpendicular to the hitting surface and generally parallel to the sole surface, and supporting an upper portion of the thin-plate pendulum body, wherein the thin-plate pendulum body is swingable on an axis of the rotation axis member and supported by the rotation axis member so as to be always oriented vertically, the thin-plate pendulum body being perpendicular to the sole surface and extending upwardly in an upward direction away from the sole surface when the putter head is placed with the sole surface horizontal.

2. The putter as set forth in claim 1, the putter head, further comprising:

a cover attached to the putter bead and having an upper cover plate located above the upper end surface of the thin-plate pendulum body when the putter head is placed with the sole surface horizontal, the upper cover plate having a first slit formed with a pair of side edges through the upper cover plate and having a width larger than a thickness of the thin-plate pendulum body, the upper end surface of the thin-plate pendulum being located at a widthwise center of the first slit.

3. The putter as set forth in claim 2, wherein the cover is made of a reinforced glass or light-transmissive resin.

4. The putter as set forth in claim 2, the putter head, further comprising:

a lower cover plate of the cover located below the thin-plate pendulum body when the putter head is placed with the sole surface horizontal, the lower cover plate having a second slit parallel to the first slit and formed with a pair of side edges, both side edges of the first slit coinciding with both side edges of the second slit in identical vertical planes when the putter head is placed with the sole surface horizontal.

5. The putter as set forth in claim 4, wherein an upper surface of the lower cover plate is provided with lighting reflectors along both side edges of the second slit, and a lower surface of the upper cover plate is provided with light-collecting reflectors along both side edges of the first slit.

6. The putter as set forth in claim 5, wherein the light-collecting reflectors of the upper cover plate are located below the upper end surface of the thin-plate pendulum body when the putter head is placed with the sole surface horizontal.

7. The putter as set forth in claim 1, wherein the thin-plate pendulum body is able to be fixed at a desired or predetermined angle relative to the sole surface.

8. The putter as set forth in claim 7, the putter head, further comprising:

a retaining member having a permanent magnet for the thin-plate pendulum body on the opposite side of the hitting surface, the retaining member being able to attract the thin-plate pendulum body to the retaining member by the permanent magnet, the retaining member being movable in a direction perpendicular to an extending direction of the rotation axis member, along the sole surface;

wherein the thin-plate pendulum body is fixed at the predetermined angle relative to the sole surface, in a rotated state on the axis of the rotation axis member, by moving the retaining member to a predetermined position and attracting the thin-plate pendulum body to the retaining member through the permanent magnet of the retaining member.

9. The putter as set forth in claim 8, wherein the retaining member has a vertical portion for attaching the permanent magnet and a horizontal mounting portion mounted on it bolt, an influence of the permanent magnet on the thin-plate pendulum body is eliminated by rotating the retaining member a half-turn on the bolt in a manner such that the vertical portion is located away from the thin-plate pendulum body.

10. The putter as set forth in claim 8, wherein the thin-plate pendulum body has a metal weight, the permanent magnet of the retaining member attracting the metal weight to attract the thin-plate pendulum body to the retaining member.

11. The putter as set forth in claim 7, the putter head, further comprising:

a retaining member having a screw for the thin-plate pendulum body on the opposite side of the hitting surface, the retaining member being able to retain the thin-plate pendulum body by screwing the screw into the thin-plate pendulum body, the retaining member being movable in a direction perpendicular to an extending, direction of the rotation axis member, along the sole surface;

wherein the thin-plate pendulum body is fixed at the predetermined angle relative to the sole surface, in a rotated state on the axis of the rotation axis member by moving the retaining member to a predetermined position and screwing the screw into the thin-plate pendulum body.

12. The putter as set forth in claim 11, wherein the thin-plate pendulum body has an internally threaded hole, the screw of the retaining member being screwed into the internally threaded hole, thereby into the thin-plate pendulum body.

13. The putter as set forth in claim 1, wherein the hitting surface is made of one of an oleoresin and an oil-impregnated metal.

14. The putter as set forth in claim 1, wherein the hitting surface is made of one of a composite oleoresin and an oil-impregnated composite metal.

15. The putter as set forth in claim 1, wherein a line extending from the upper end surface of the thin-plate pendulum body through the hitting, surface indicates a moving direction of a golf ball.

* * * * *